US009187952B2

(12) United States Patent
Vestal et al.

(10) Patent No.: US 9,187,952 B2
(45) Date of Patent: Nov. 17, 2015

(54) CORDLESS BLIND SYSTEM AND RETRO-FIT METHOD

(75) Inventors: William D. Vestal, Bulington, NC (US); Robert S. Pharr, Hickory, NC (US)

(73) Assignee: SAFE-T-SHADE, Huntersville, NC (US)

( * ) Notice: Subject to any disclaimer, the term of this patent is extended or adjusted under 35 U.S.C. 154(b) by 0 days.

(21) Appl. No.: 13/035,222

(22) Filed: Feb. 25, 2011

(65) Prior Publication Data

US 2011/0259534 A1 Oct. 27, 2011

Related U.S. Application Data

(60) Provisional application No. 61/309,426, filed on Mar. 2, 2010, provisional application No. 61/325,807, filed on Apr. 19, 2010, provisional application No. 61/353,653, filed on Jun. 10, 2010, provisional application No. 61/411,336, filed on Nov. 8, 2010.

(51) Int. Cl.

| | |
|---|---|
| ***E06B 9/324*** | (2006.01) |
| *E06B 9/325* | (2006.01) |
| *E06B 9/322* | (2006.01) |

(52) U.S. Cl.

CPC ..... *E06B 9/324* (2013.01); *E06B 9/325* (2013.01); *E06B 2009/3222* (2013.01)

(58) Field of Classification Search

USPC ..... 160/178.2, 168.1 R, 178.1 R, 173 R
IPC ..... E06B 9/324,9/325, 2009/3222
See application file for complete search history.

(56) References Cited

U.S. PATENT DOCUMENTS

| | | | | |
|---|---|---|---|---|
| 1,962,964 | A | 6/1934 | Morrison | |
| 2,226,393 | A | 12/1940 | Seeger et al. | |
| 2,410,549 | A * | 11/1946 | Olson | 160/168.1 R |
| 2,557,877 | A | 6/1951 | Kluson | |
| 2,577,046 | A | 12/1951 | Svirsky | |
| 3,022,819 | A | 2/1962 | Lampret | |
| 3,633,646 | A | 1/1972 | Zilver | |

(Continued)

FOREIGN PATENT DOCUMENTS

| | | |
|---|---|---|
| CA | 2201209 A1 | 9/1998 |
| FR | 2785639 A1 | 5/2000 |

OTHER PUBLICATIONS

International Search Report for PCT/US2012/034990 mailed Jul. 20, 2012, 9 pages.

(Continued)

*Primary Examiner* — David Purol
(74) *Attorney, Agent, or Firm* — Withrow & Terranova, PLLC

(57) ABSTRACT

An enclosed drive system for use in conjunction with a lift cord extending from a headrail of an architectural cover. The enclosed system encases and engages the lift cord with a drive mechanism within the enclosure, thereby avoiding hazardous loops. A method for retro-fitting an architectural cover lift cord assembly including a lift cord associated with a cord lock and extending from a headrail of the architectural cover is also described, for modifying the architectural cover to eliminate hazardous loops therefrom. Also disclosed in this disclosure is a cord lock mechanism that pinches the cord, a handle that actuates the cord lock mechanism, and a driving mechanism having a cord guide that engages the cord and a slider that slides along the handle to actuate the cord while the cord is enclosed within an enclosure defined by the handle.

9 Claims, 24 Drawing Sheets

(56) References Cited

U.S. PATENT DOCUMENTS

| | | | | |
|---|---|---|---|---|
| 3,795,267 | A | 3/1974 | Debs | |
| 4,352,386 | A * | 10/1982 | Butler et al. | 160/178.2 |
| 4,685,502 | A | 8/1987 | Spangenberg | |
| 4,807,683 | A | 2/1989 | Hennequin et al. | |
| 4,817,698 | A | 4/1989 | Rossini et al. | |
| 4,865,108 | A | 9/1989 | Hennequin et al. | |
| 4,865,109 | A | 9/1989 | Sherman | |
| 5,070,805 | A | 12/1991 | Plante | |
| 5,273,096 | A | 12/1993 | Thomsen et al. | |
| 5,315,741 | A | 5/1994 | Dubberke | |
| 5,365,641 | A | 11/1994 | Watanabe et al. | |
| 5,463,797 | A | 11/1995 | Laug et al. | |
| 5,465,775 | A | 11/1995 | Biba et al. | |
| 5,465,779 | A | 11/1995 | Rozon | |
| 5,472,035 | A | 12/1995 | Biba et al. | |
| 5,501,262 | A | 3/1996 | Inaba et al. | |
| 5,513,687 | A | 5/1996 | Tuzmen et al. | |
| 5,553,649 | A | 9/1996 | Chisaka et al. | |
| 5,553,653 | A | 9/1996 | Rozon | |
| 5,595,232 | A | 1/1997 | Benthin | |
| 5,645,685 | A | 7/1997 | Furhman | |
| 5,657,513 | A | 8/1997 | Takahashi | |
| 5,657,807 | A | 8/1997 | Hsu | |
| 5,666,699 | A | 9/1997 | Takahashi | |
| 5,671,793 | A * | 9/1997 | Lee | 160/168.1 R |
| 5,706,876 | A | 1/1998 | Lysyj | |
| 5,709,258 | A * | 1/1998 | Coccoluto | 160/168.1 R |
| 5,722,478 | A | 3/1998 | Claypool et al. | |
| 5,749,405 | A * | 5/1998 | Huang | 160/168.1 R |
| 5,752,558 | A | 5/1998 | Lin | |
| 5,797,441 | A | 8/1998 | Benthin | |
| 5,819,832 | A * | 10/1998 | Huang | 160/168.1 R |
| 5,850,863 | A | 12/1998 | Huang | |
| 5,862,850 | A | 1/1999 | Yang | |
| 5,904,198 | A | 5/1999 | Huang | |
| 6,062,292 | A | 5/2000 | Bryant | |
| 6,164,291 | A | 12/2000 | Filippone | |
| 6,189,595 | B1 | 2/2001 | Lee | |
| 6,196,293 | B1 | 3/2001 | Lee | |
| 6,463,987 | B1 * | 10/2002 | Nevins | 160/178.1 R |
| 6,477,748 | B2 | 11/2002 | Steiner | |
| 6,516,860 | B1 | 2/2003 | Weaver et al. | |
| 6,591,461 | B2 | 7/2003 | Salentine et al. | |
| 6,601,633 | B2 | 8/2003 | Sun et al. | |
| 6,644,374 | B2 * | 11/2003 | Nien | 160/168.1 R |
| 6,680,594 | B2 | 1/2004 | Collett et al. | |
| 6,685,592 | B2 | 2/2004 | Fraczek et al. | |
| 6,752,194 | B1 * | 6/2004 | Huang | 160/168.1 R |
| 6,792,995 | B2 | 9/2004 | Judkins | |
| 6,817,399 | B2 | 11/2004 | Berman et al. | |
| 6,948,216 | B2 | 9/2005 | Gaudyn et al. | |
| 7,036,547 | B1 | 5/2006 | Cheng et al. | |
| 7,117,920 | B2 | 10/2006 | Dekker et al. | |
| 7,124,801 | B2 | 10/2006 | Ng et al. | |
| 7,204,292 | B2 | 4/2007 | Nien | |
| 7,261,138 | B2 | 8/2007 | Judkins et al. | |
| 7,337,503 | B1 | 3/2008 | Ashbrook | |
| 7,464,742 | B2 | 12/2008 | Oskam et al. | |
| 7,597,131 | B2 | 10/2009 | Nien et al. | |
| 7,624,784 | B2 | 12/2009 | Anthony et al. | |
| 7,669,633 | B2 | 3/2010 | Berger | |
| 7,770,625 | B2 | 8/2010 | Lukos | |
| 7,775,254 | B2 | 8/2010 | Judkins et al. | |
| 7,832,450 | B2 | 11/2010 | Brace et al. | |
| 7,938,161 | B2 | 5/2011 | Lin | |
| 8,091,606 | B2 | 1/2012 | Nien et al. | |
| 8,113,261 | B2 | 2/2012 | Lin | |
| 8,205,316 | B2 | 6/2012 | Chu | |
| 8,220,517 | B2 | 7/2012 | Kollman et al. | |
| 8,225,463 | B2 | 7/2012 | Bourke et al. | |
| 8,245,360 | B2 | 8/2012 | Stafford et al. | |
| 8,256,489 | B2 | 9/2012 | Berger | |
| 8,267,144 | B2 | 9/2012 | Hsu et al. | |
| 8,281,842 | B2 | 10/2012 | Lin | |
| 8,286,686 | B2 | 10/2012 | Cannaverde | |
| 8,291,959 | B2 | 10/2012 | Cheng | |
| 8,316,911 | B2 | 11/2012 | Cleaver | |
| 8,356,653 | B2 | 1/2013 | Fu-Lai et al. | |
| 8,365,362 | B2 | 2/2013 | Chou | |
| 8,381,792 | B2 | 2/2013 | Perkowitz | |
| 8,474,509 | B2 | 7/2013 | Koop | |
| 8,499,815 | B2 | 8/2013 | Zhang | |
| 8,511,363 | B2 | 8/2013 | Lin | |
| 8,544,525 | B2 | 10/2013 | Zhu | |
| 8,550,141 | B2 | 10/2013 | Ding | |
| 8,763,675 | B2 | 7/2014 | Zhu | |
| 2003/0192654 | A1 * | 10/2003 | Nien | 160/168.1 R |
| 2003/0192655 | A1 * | 10/2003 | Nien | 160/168.1 R |
| 2003/0201076 | A1 * | 10/2003 | Nien | 160/168.1 R |
| 2004/0003900 | A1 * | 1/2004 | Nien | 160/168.1 R |
| 2004/0108080 | A1 | 6/2004 | Nien | |
| 2004/0200583 | A1 | 10/2004 | Nien | |
| 2005/0109468 | A1 | 5/2005 | Hsu | |
| 2006/0157204 | A1 | 7/2006 | Lin | |
| 2006/0243402 | A1 | 11/2006 | Chang | |
| 2007/0023149 | A1 | 2/2007 | Lamars et al. | |
| 2007/0235147 | A1 | 10/2007 | Zakowski et al. | |
| 2008/0083511 | A1 | 4/2008 | Hung | |
| 2009/0064473 | A1 | 3/2009 | Chan | |
| 2009/0071610 | A1 | 3/2009 | Bossler | |
| 2010/0101741 | A1 | 4/2010 | Koop | |
| 2010/0126673 | A1 | 5/2010 | Lin | |
| 2010/0126674 | A1 | 5/2010 | Lin | |
| 2010/0126679 | A1 | 5/2010 | Lin | |
| 2010/0193141 | A1 | 8/2010 | Liang et al. | |
| 2010/0212120 | A1 | 8/2010 | LeBlanc | |
| 2010/0257701 | A1 | 10/2010 | Gammell et al. | |
| 2010/0269984 | A1 | 10/2010 | Hanley et al. | |
| 2010/0269985 | A1 | 10/2010 | Hanley et al. | |
| 2010/0294438 | A1 | 11/2010 | Kirby et al. | |
| 2010/0326608 | A1 | 12/2010 | Wen et al. | |
| 2011/0036512 | A1 | 2/2011 | Su | |
| 2011/0048652 | A1 | 3/2011 | Chen | |
| 2011/0056633 | A1 | 3/2011 | Lin | |
| 2011/0067820 | A1 | 3/2011 | Hsu et al. | |
| 2011/0073260 | A1 | 3/2011 | Kollman et al. | |
| 2011/0083816 | A1 | 4/2011 | Chen | |
| 2011/0107557 | A1 | 5/2011 | Bourke et al. | |
| 2011/0108206 | A1 | 5/2011 | Hsu et al. | |
| 2011/0132554 | A1 | 6/2011 | Lin | |
| 2011/0168339 | A1 | 7/2011 | Bowen et al. | |
| 2011/0192549 | A1 | 8/2011 | Wen et al. | |
| 2011/0192550 | A1 | 8/2011 | Williams | |
| 2011/0192557 | A1 | 8/2011 | Ling | |
| 2011/0247761 | A1 | 10/2011 | Lin | |
| 2011/0247762 | A1 | 10/2011 | Lin | |
| 2011/0247763 | A1 | 10/2011 | Hu et al. | |
| 2011/0247765 | A1 | 10/2011 | Lin | |
| 2011/0297336 | A1 | 12/2011 | Chen | |
| 2011/0297337 | A1 | 12/2011 | Chen | |
| 2012/0067527 | A1 | 3/2012 | Cheng | |
| 2012/0097342 | A1 | 4/2012 | Tu | |
| 2012/0097343 | A1 | 4/2012 | O'Hair | |
| 2012/0267056 | A1 | 10/2012 | Ko | |
| 2012/0285634 | A1 | 11/2012 | Zhu | |
| 2013/0068405 | A1 | 3/2013 | Lava et al. | |

OTHER PUBLICATIONS

Non-final Office Action for U.S. Appl. No. 13/094,727 mailed Aug. 29, 2012, 19 pages.

International Search Report for International patent application PCI/US2010/062057 mailed Oct. 27, 2011, 20 pages.

International Search Report for PCT/US2011/026410 mailed May 3, 2012, 13 pages.

International Search Report for PCT/US2012/034984 mailed Jul. 13, 2012, 9 pages.

Non-final Office Action for U.S. Appl. No. 13/738,387 mailed May 13, 2013, 15 pages.

Non-Final Office Action for U.S. Appl. No. 13/094,727, mailed Apr. 10, 2013, 13 pages.

Final Office Action for U.S. Appl. No. 12/976,732, mailed Jun. 25, 2013, 16 pages.

(56) References Cited

OTHER PUBLICATIONS

Partial European Search Report for European patent application 13166761.0 mailed Nov. 20, 2013, 8 pages.
Non-final Office Action for U.S. Appl. No. 12/976,732 mailed Dec. 18, 2013, 12 pages.
Extended European Search Report for European patent application 13166761.0 mailed Apr. 1, 2014, 11 pages.
Non-Final Office Action for U.S. Appl. No. 13/094,705, mailed May 29, 2014, 6 pages.
Notice of Allowance for U.S. Appl. No. 12/976,732, mailed May 1, 2014, 8 pages.
Notice of Allowance and Applicant-Initiated Interview Summary for U.S. Appl. No. 12/976,677 mailed Dec. 29, 2014, 10 pages.
Final Office Action for U.S. Appl. No. 13/094,705 mailed Oct. 28, 2014, 9 pages.
Non-Final Office Action for U.S. Appl. No. 14/021,181 mailed Oct. 30, 2014, 8 pages.
Notice of Allowance and Applicant-Initiated Interview Summary for U.S. Appl. No. 13/094,727 mailed Oct. 31, 2014, 9 pages.
Author Unknown, "On," Dictionary.com, accessed Jun. 29, 2014, http://dictionary.reference.com/browse/on, Random House, Inc., 1 page.
Final Office Action for U.S. Appl. No. 12/976,677, mailed Jul. 9, 2014, 16 pages.
Final Office Action for U.S. Appl. No. 13/094,727 mailed Jul. 17, 2014, 12 pages.
Notice of Allowance for U.S. Appl. No. 13/094,705, mailed Aug. 4, 2015, 8 pages.
Notice of Allowance for U.S. Appl. No. 14/021,181, mailed Jun. 24, 2015, 8 pages.
Advisory Action for U.S. Appl. No. 13/094,705, mailed Apr. 7, 2015, 3 pages.
Non-final Office Action for U.S. Appl. No. 12/976,732 mailed Nov. 19, 2012, 14 pages.
Non-final Office Action for U.S. Appl. No. 13/094,705 mailed Jan. 14, 2013, 6 pages.
International Preliminary Report on Patentability for PCT/US2012/034984 mailed Nov. 7, 2013, 7 pages.
International Preliminary Report on Patentability for PCT/US2012/034990 mailed Nov. 7, 2013, 7 pages.
Final Office Action for U.S. Appl. No. 13/094,705 mailed Jul. 18, 2013, 6 pages.
Notice of Allowance for U.S. Appl. No. 13/738,387 mailed Jul. 10, 2013, 9 pages.
Non-final Office Action for U.S. Appl. No. 12/976,677 mailed Nov. 19, 2013, 10 pages.
Non-final Office Action for U.S. Appl. No. 13/094,727 mailed Nov. 25, 2013, 10 pages.
First Examination Report for New Zealand patent application 610332 mailed May 10, 2013, 2 pages.
International Preliminary Report on Patentability for International patent application PCT/US2010/062057 mailed Jul. 4, 2013, 14 pages.

* cited by examiner

INSERT LOCK TAB ELIMINATOR AND SNAP ONTO CORD LOCK SHAFT

17
ROTATE TAB ELIMINATOR AND PEEL BACKING FROM DOUBLEC FACED TAPE

PRESS LOCK TAB ELIMINATOR FIRMLY AGAINST SHADE BOTTOM FACE

EDGE OF LOCKTAB ELIMINATOR IS USED LATER TO LOCATE SHADE MOUNTING CLIP

CORDLESS BLIND SYSTEM AND RETRO-FIT METHOD

This application claims the benefit of provisional patent application Ser. No. 61/309,426, entitled "Cordless Blind System and Retro-Fit Method", filed Mar. 2, 2010, and provisional patent application Ser. No. 61/325,807, entitled "Cordless Blind System and Retro-Fit Method", filed Apr. 19, 2010, provisional patent application Ser. No. 61/353,653, entitled "Cordless Blind System and Retro-Fit Method", filed Jun. 10, 2010, and provisional patent application Ser. No. 61/411,336, entitled "Cordless Blind System and Retro-Fit Method", filed Nov. 8, 2010 the disclosures of which are hereby incorporated herein by reference in their entireties.

FIELD OF THE DISCLOSURE

The present invention relates to cordless window and architectural passage coverings. In one aspect, the invention relates to an enclosed drive system for use in conjunction with a pull cord extending from a headrail of an architectural cover. In another aspect, the invention relates to a method for retrofitting an architectural cover pull cord assembly including a pull cord associated with a cord lock and extending from a headrail of the architectural cover. More generally, the invention provides solutions for blinds, shades and other architectural coverings that would otherwise have an exposed hazardous loop.

BACKGROUND

In the provision of window and architectural passage coverings, the art has long relied on cords, string or the like to extend and retract the coverings. Such coverings take many forms, including shades such as curtains, roll-up shades, Venetian blinds, vertical blinds, cellular shades, and the like. A primary problem with such coverings that rely on cords is that small children can become entangled in the cords and experience serious harm, including strangulation and death. On Aug. 26, 2009, the U.S. Consumer Product Safety Commission announced a voluntary recall of all ¼ inch Oval Roll-up Blinds and Woolrich Roman Shades, including some 4.2 million roll-up blinds and 600,000 Roman shades, (http://www.cpsc.gov/cpscpub/prerel/prhtml09/09324.html). The Commission referenced the hazard that "[s]trangulations can occur if the lifting loops slide off the side of the blind and a child's neck becomes entangled on the free-standing loop or if a child places his/her neck between the lifting loop and the roll-up blind material." Recent cited injuries include a report that "[i]n November 2007, a 1-year-old boy from Norridgewock, Me. became entangled and strangled in the lift cord loop of a roll-up blind that had fallen into his portable crib. In October 2008, a 13-month-old boy from Conway, AR was found with his head between the exposed inner cord and the cloth on the backside of a Roman shade. The cord was not looped around the boy's neck but rather ran from ear to ear and strangled the child." Numerous manufacturers and retailers have followed the recall. Additional information may be found at: (http://www.windowcoverings.org).

In addition to the internal cords attached to the shade or blinds that can be pulled out and pose a problem, the pull cords, string and beaded cords in mechanical-based blinds and shades that are pulled on to draw up the blinds or shades also pose a risk since they also create a hazardous loop of sufficient diameter (12 inches according to the Consumer Product Safety Commission) for a small child to get their head tangled inside. The retrofit devices currently available (http://www.windowcoverings.org/how_to_retrofit.html) do not eliminate the hazardous loops created by the beaded cords even if they are tied to the wall with a tie-down device such as a Rollease™ product or with separated draw strings and/or cord stops that could still become tangled together to create a hazardous loop.

U.S. Pat. No. 5,472,035 discloses a window blind lift cord operating mechanism incorporated into the twist wand that rotates to control tilting of blind slats, wherein the operating mechanism for raising and lowering the blind and locking the blind in adjusted positions includes a lift member mounted for movement along an outer side of the wand that drives an engaging member inside the wand that engages the lift cords that also extend into a lengthwise cord passage inside the wand. The disclosed operating means also includes a lock means for locking the lift cord engaging member at selected positions along the wand. One problem with this configuration is the obvious entanglement issues that would result with the lift cords internal to a wand that is rotated to control tilting of the blind slats, wherein securing the cord within the rotating wand almost guarantees entanglement. In addition, the weight and force required to lift the bottom rail along with the blind slats would create a significant burden on the rotating gears that open and close the blind slats including the entire attachment of the wand to the headrail.

In consequence, the art is in need of improvement in coverings for architectural openings that maintains the functionality and aesthetics of previously developed coverings, but avoids their deficiencies, particularly their hazardous character regarding the risk of injury or death associated with the use of cord arrangements. The art also is in need of a new structural "fix" for the lifting mechanism of shades and blinds that avoids creating a hazardous loop.

SUMMARY

The present invention relates to cordless architectural coverings, and assemblies and subassemblies thereof, as well as to retrofit apparatus, components and methods in which a cord loop enclosure for shades and blinds is employed to replace looped beaded cords, pull cords, and strings that drive rolling mechanisms to draw up the blinds or shades.

In one aspect, the invention relates to a mechanism for disabling the cord lock found in many blinds and shades that allows a user to draw up and "lock" the blind or shade in an open, closed or in-between position.

In another aspect, the invention relates to an enclosure or sheathed apparatus coupled with a drive mechanism to encase a pull cord on a blind or shade system, for the purpose of avoiding exposed cords capable of creating a hazardous loop.

In a further aspect, the invention relates to an enclosed pulley system and method of retro-fitting an existing blind or shade with such enclosed pulley system.

In another aspect, a loop cord control enclosure is disclosed to encase a looped cord attached to the shade or blind system at a top part thereof to drive the rolling mechanism that raises and lowers the shade or blinds. The cord is encased to protect any hazardous loops from being exposed, and the cord is engaged internally with one or more drive mechanisms, with at least one attached to a handle to allow an operator to draw the cord and shade/blind up and down. The mechanism is adapted to be retrofitted on an existing shade/blind or originally fit on any of the systems described above. In one embodiment, the loop cord enclosure is attached at the headrail, includes a cord lock disablement mechanism to disable the cord lock to allow the cord and shade/blind to freely open and close without locking, and wherein the cord is encased in the enclosure with at least one drive mechanism coupled to a handle to drive the system.

A further aspect of the invention relates to a drive system for use in conjunction with a lift or pull cord extending from a headrail of an architectural cover, such drive system including: an enclosure adapted to conceal at least a portion of the pull cord; a first drive mechanism in the enclosure, adapted to engage the pull cord, and coupled to a handle mechanism for manual operation; a bracket adapted to connect the enclosure to the headrail of the architectural cover; and a cord lock disablement mechanism for disabling a cord lock of the architectural cover.

In various further implementations, the invention relates to a drive system wherein the first drive mechanism yields a handle to pull cord power ratio of 2:1 by use of at least one pulley or pulley-like apparatus. In an alternative implementation, the cord could instead be attached directly to a handle mechanism directly to effectuate a pull cord power of 1:1. In other implementations, the invention relates to a second drive mechanism adapted to engage the pull cord, wherein the second drive mechanism yields a handle to pull cord power ratio of 4:1. In other implementations, the invention relates to a handle mechanism that further includes a drive mechanism that is either a sleeve adapted to slide along the outside of the enclosure or a slider devise adapted to traverse the interior of the enclosure. In yet other implementations, the invention relates to a handle that further comprises a tension or stop mechanism adapted to secure the handle in position at one or more points along the enclosure.

In the 1:1 pull cord power system, the handle may include a cord lock to secure the cord and a cam lock slider or tension mechanism to secure the handle at any one position along the shaft to raise and lower the blind or shade and keep it at a desired position anywhere in between. In other implementations, the invention relates to a tension or stop mechanism that further comprises at least one release button to allow the handle to be moved along the enclosure, wherein the release button must be pressed to effectuate movement of the handle and corresponding drive mechanism. In still other implementations, the invention relates to a locking mechanism adapted to lock the handle in position at one or more points along the enclosure. In other implementations, the invention relates to a handle that further comprises a counter-weight mechanism adapted to lessen the force required to move the handle. In other implementations, the invention relates to a handle coupled to a spring and adapted to lessen the force required to move the handle. In other implementations, the invention relates to a cord lock disablement mechanism comprising a clamp adapted to fit within an opening in the headrail proximate to where the pull cord extends from the headrail.

A further aspect of the invention relates to a method for retro-fitting an architectural cover pull cord assembly including a pull cord associated with a cord lock and extending from a headrail of the architectural cover, such method comprising: disabling the cord lock; engaging the pull cord extending from the headrail with a drive mechanism coupled to a handle for manual operation; and enclosing the drive mechanism in an enclosure that also conceals at least a portion of the pull cord.

A still further aspect of the invention relates to a drive system for use in conjunction with one or more lift cords extending from a headrail of an architectural cover, said drive system comprising: an enclosure adapted to conceal at least a portion of at least one lift cord; a first drive mechanism in the enclosure, adapted to engage the at least one lift cord, and coupled to a handle mechanism for manual operation; and a bracket adapted to connect the enclosure to the headrail of an architectural cover, wherein the bracket includes a locking mechanism adapted to secure the at least one lift cord in place.

A still further aspect of the invention relates to a drive system for use in conjunction with one or more lift cords extending from a headrail of an architectural cover, said drive system comprising: an enclosure adapted to conceal at least a portion of at least one lift cord and arranged to be secured to a headrail of an architectural opening; a first drive mechanism in the enclosure, adapted to engage the at least one lift cord, and coupled to a handle mechanism for manual operation; a handle coupled to the first drive system; and a counterweight mechanism coupled to the first drive mechanism and adapted to secure the handle in position at one or more locations along the enclosure.

A still further aspect of the invention relates to a drive system for use in conjunction with one or more lift cords extending from a headrail of an architectural cover, said drive system comprising: an enclosure adapted to conceal at least a portion of at least one lift cord and arranged to be secured by a hinge to a headrail of an architectural opening; a first drive mechanism in the enclosure, adapted to engage the at least one lift cord, and coupled to a handle mechanism for manual operation; and wherein the hinge activates a locking mechanism adapted to secure the at least one lift cord in place.

In various further implementations, the invention relates to a method for retro fitting an architectural cover pull cord assembly, comprising securing the pull cord to a fixed position during the engagement with the drive mechanism. In other implementations, the invention relates to a method further comprising connecting a clamp to the headrail, wherein the clamp is adapted to attach the enclosure to the headrail. In other implementations, the invention relates to the method further comprising fastening a cap to the top of the enclosure. In yet other implementations, the invention relates to the method wherein the fastening of the cap secures the pull cord to the enclosure. In other implementations, the invention relates to the method wherein the cap is adapted to connect with the clamp. In still other implementations, the invention relates to the method wherein the cap is adapted to fit within an opening in the headrail proximate to where the pull cord extends from the headrail. In other implementations, the invention relates to the method wherein the cap further includes a cord lock disablement mechanism for disabling the cord lock.

In still further implementations, the invention may include a pull strip for pulling a loose lift or draw cord from an existing assembly into the enclosure for coupling to or engaging with a drive system, particularly in a retro-fit system. Another implementation of the invention relates to a cam apparatus coupled to the handle, wherein rotating the handle also rotates the cam to expand calipers to lock the handle and corresponding shade/blind in place at any desired point. Another aspect includes the cord lock that has an extension to keep the top cap and/or bracket from sliding along the shade/blind headrail, particularly by including a matching gap, hole or space to accommodate the extension of the cord lock.

In still yet a further implementation, the invention has a cord lock mechanism that pinches the cord, a handle that actuates the cord lock mechanism, and a driving mechanism having a cord guide that engages the cord and a slider that slides along the handle to actuate the cord while the cord is enclosed within an enclosure defined by the handle.

Other aspects, features and embodiments of the invention will be more fully apparent from the ensuing disclosure and appended claims.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

Figure 7:
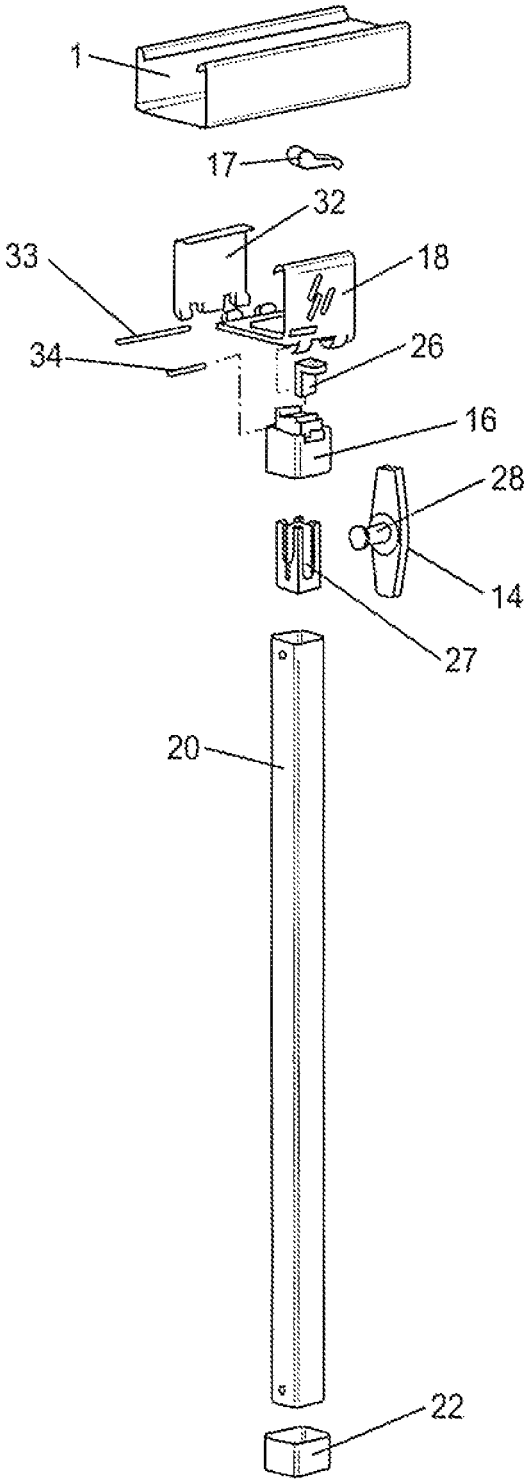

FIG. 7 discloses a representative exploded view of an enclosed drive system for use in conjunction with a lift cord extending from a headrail of an architectural cover.

Figure 8:
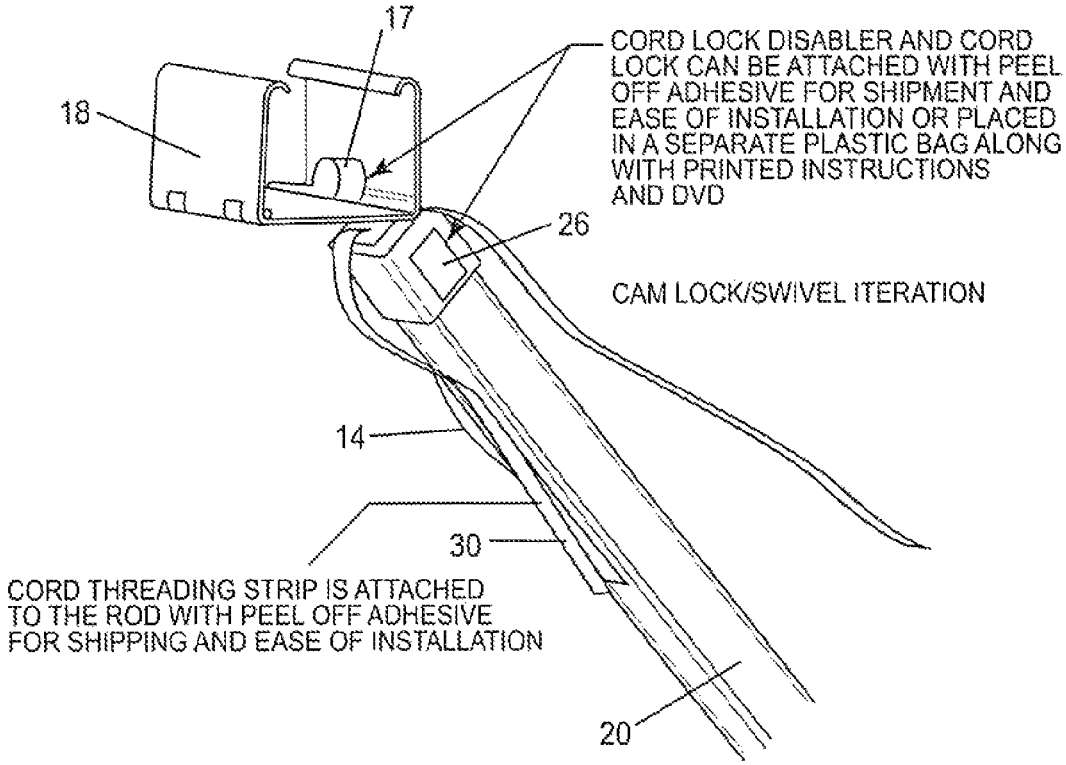

FIG. 8 is a representative view of an enclosed drive system for use in conjunction with a lift cord extending from a headrail of an architectural cover with the enclosure secured via a multi-directional attachment to the mounting bracket.

Figure 9:
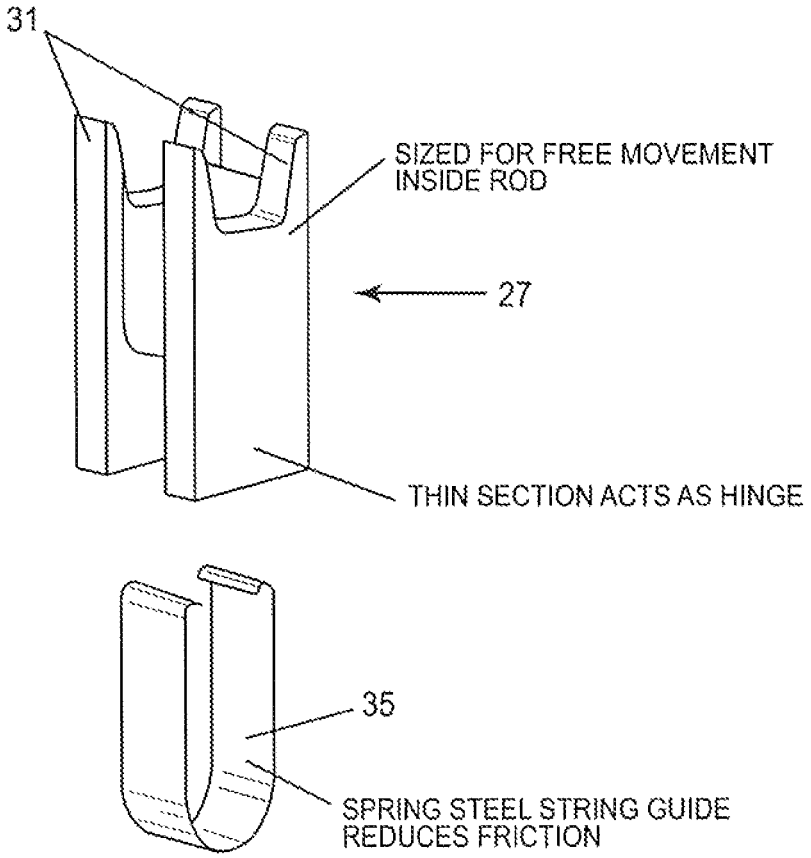

FIG. 9 is a representative view of an enclosed drive system for use in conjunction with a lift cord extending from a headrail of an architectural cover, wherein the enclosed drive system utilizes a cam lock slider.

Figure 10:
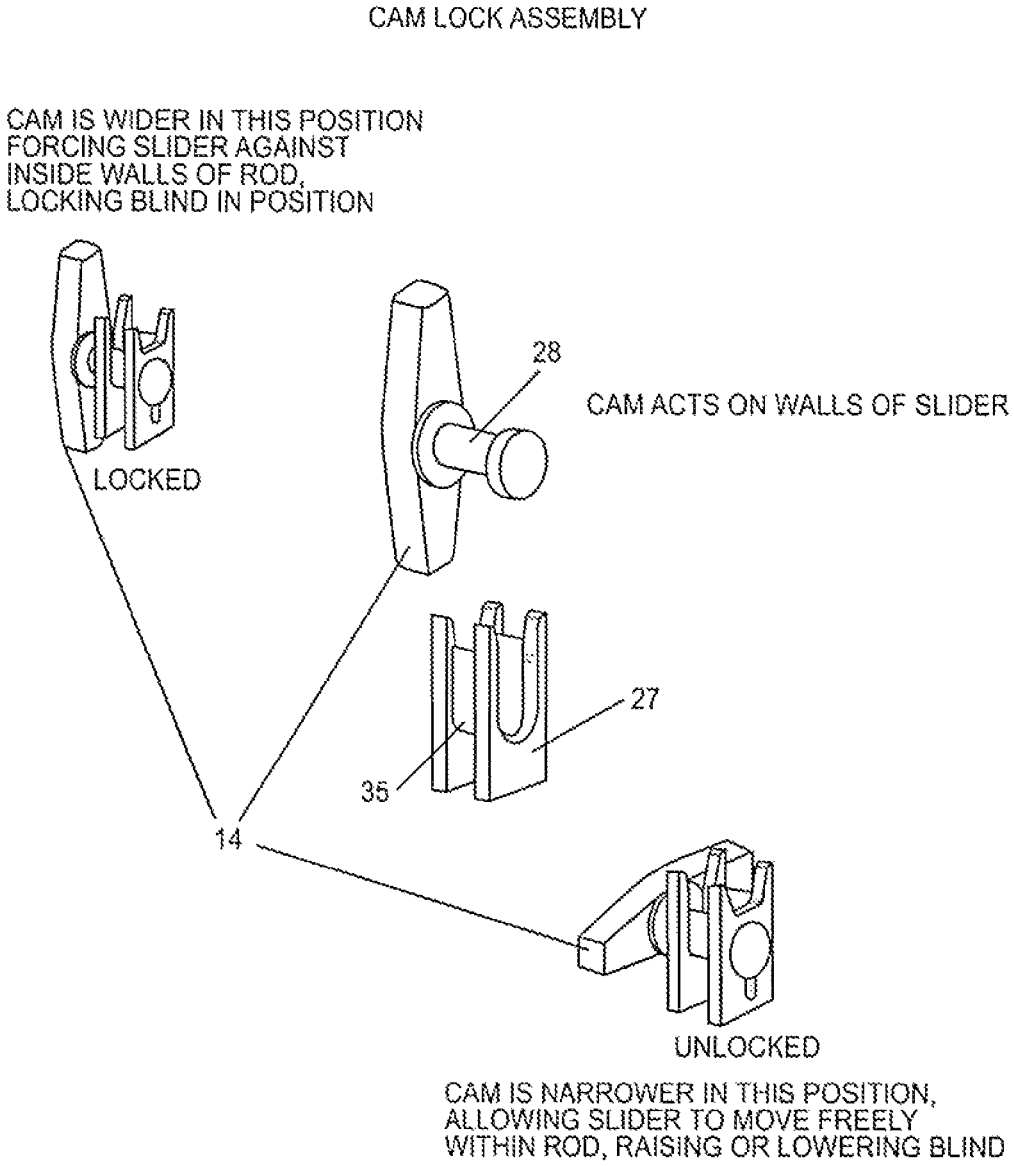

FIG. 10 is a representative view of cam lock slider and cam of the handle as disclosed in various embodiments from a closed or locked position to an open or unlocked position.

Figure 11:
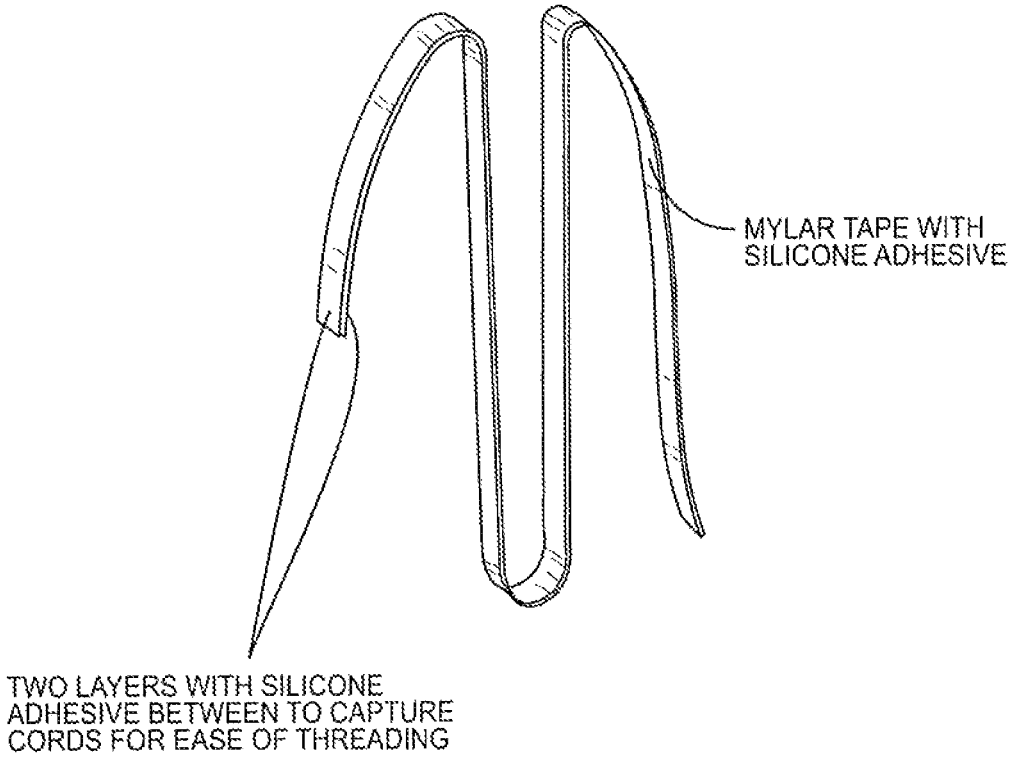

FIG. 11 is a representative view of pull strip for drawing the lift cord through the enclosed drive system.

Figure 12:
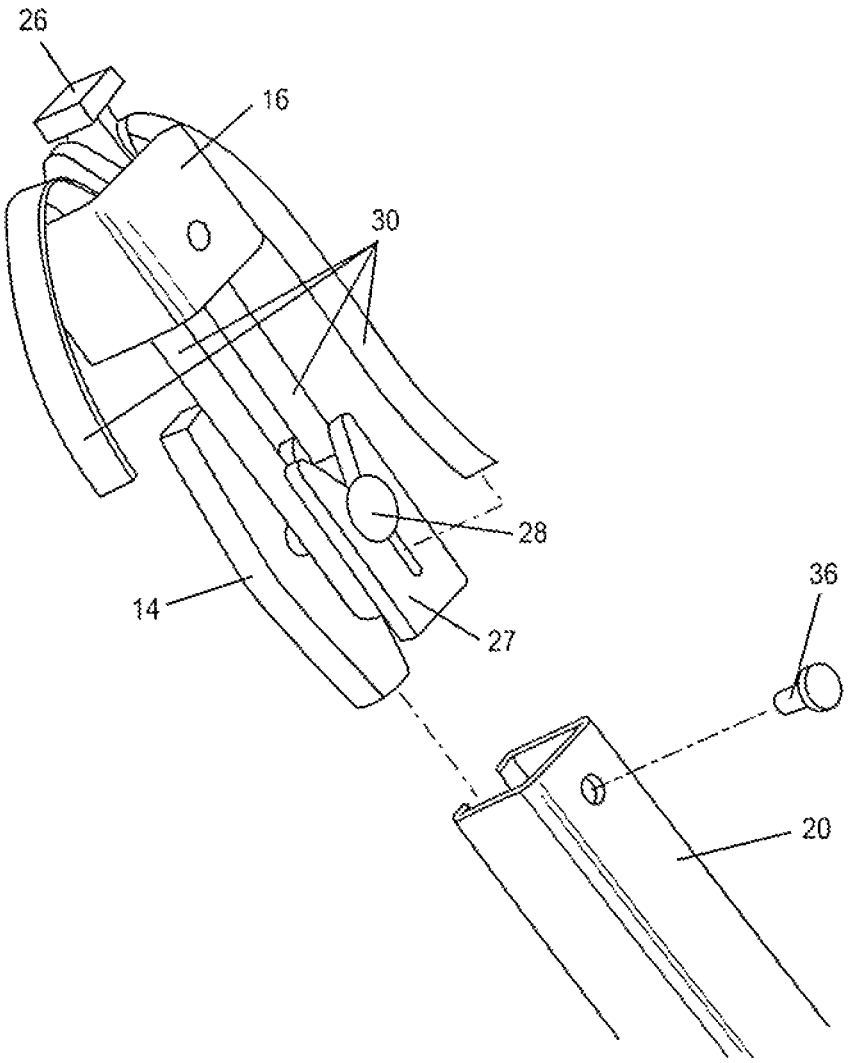
Figures 13A, 13B, 13C, 13D:
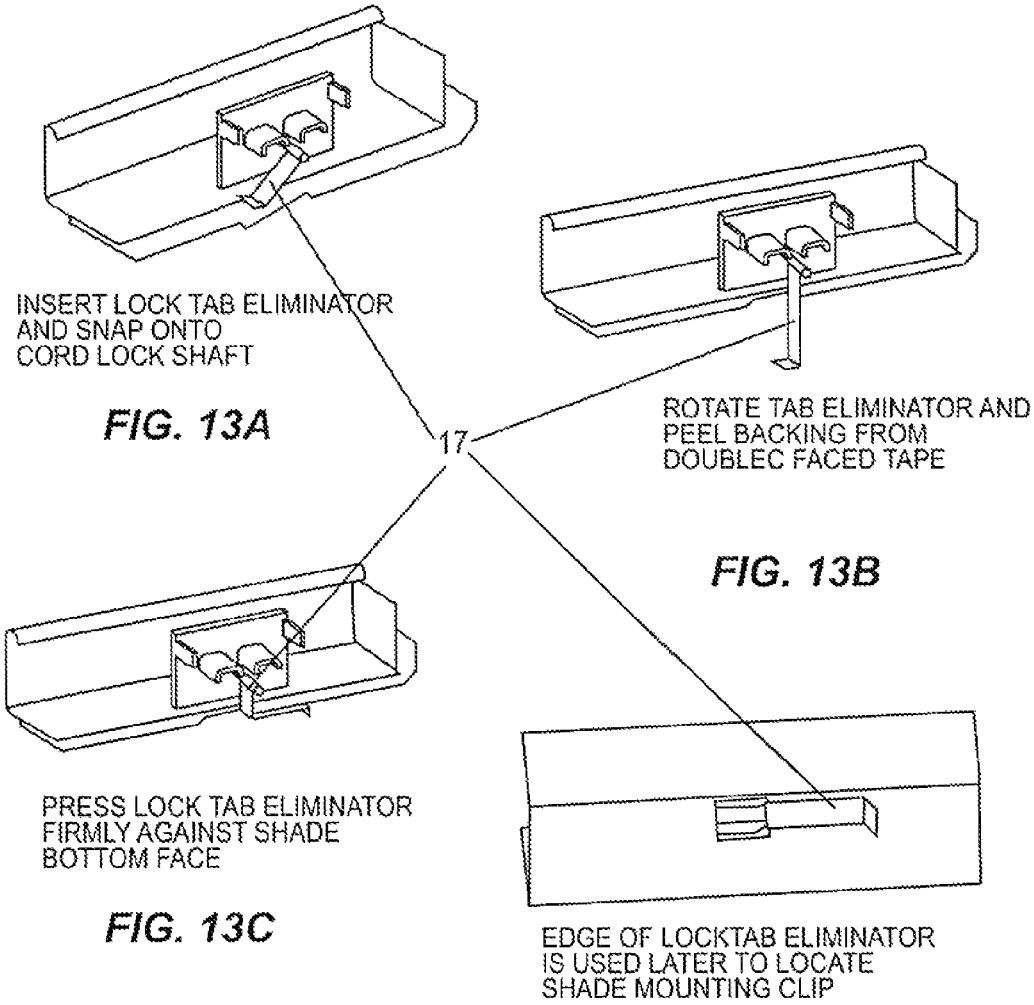

FIG. 12 is a representative view of the drive mechanism being engaged with the enclosure.

FIGS. 13A-D are representative views of the installation of a cord lock disablement device installation.

Figure 14:
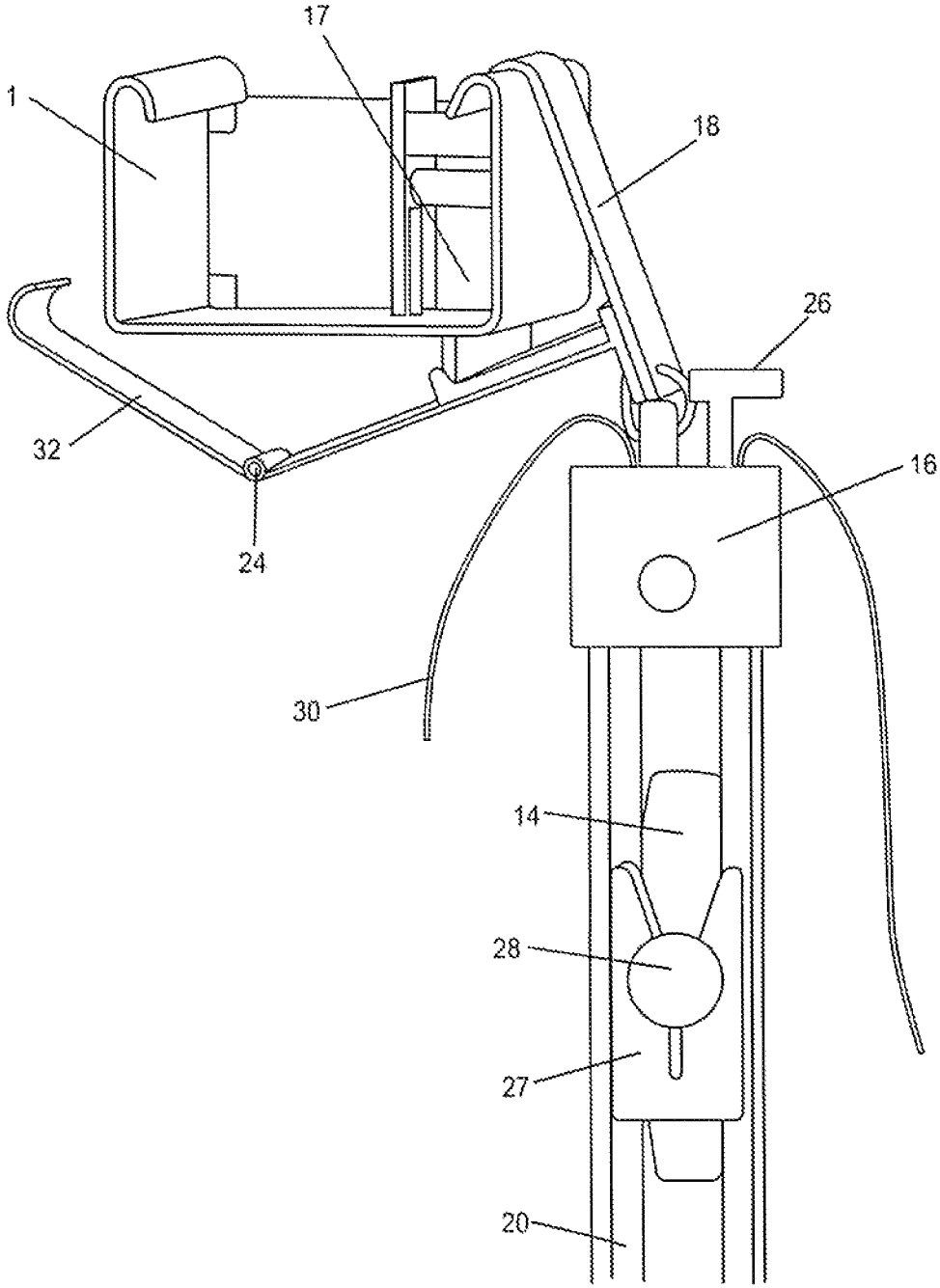

FIG. 14 is a representative view of an enclosed drive system being installed on a headrail.

Figure 15:
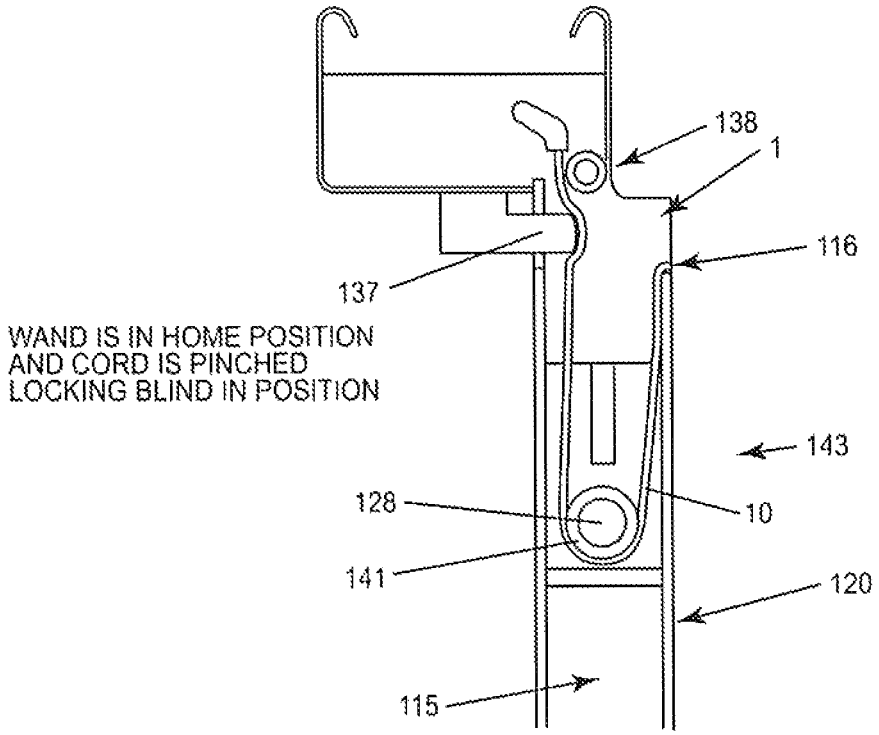
Figure 16:
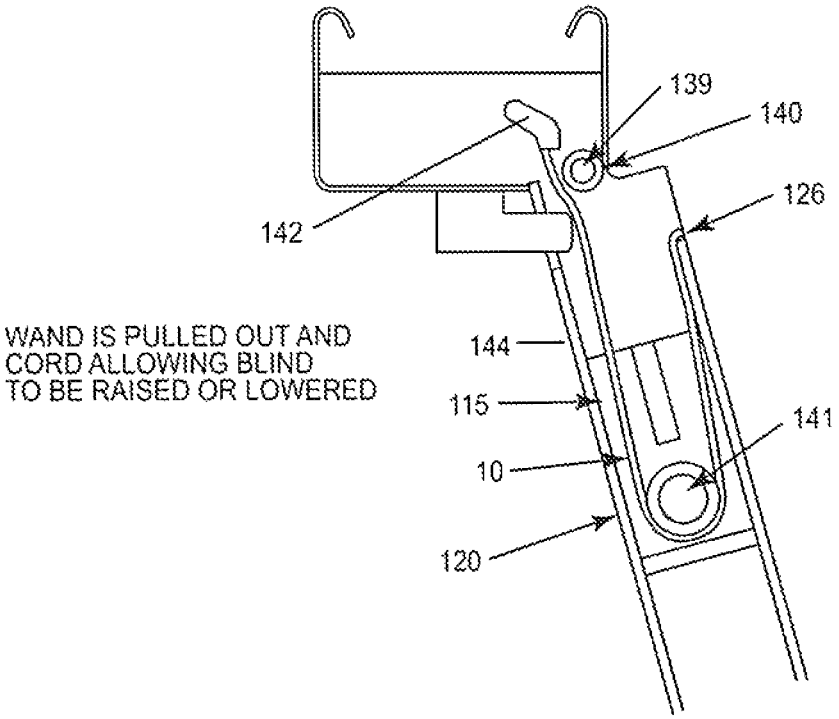

FIGS. 15 and 16 disclose various other embodiment, particularly including a cord lock mechanism 137 located near the headrail to pinch the cord 10 when in a relatively vertical position 143 and unlock the cord 10 when in a predetermined angle 144 from the relatively vertical position.

Figure 17:
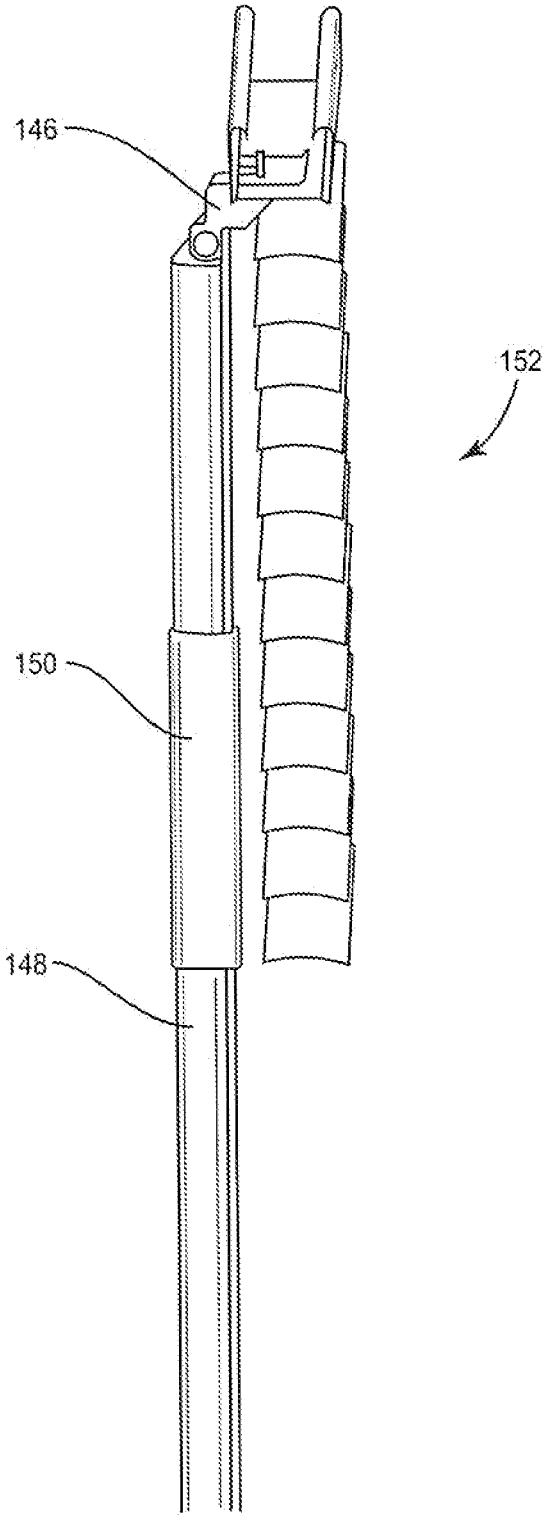

FIG. 17 illustrates a another embodiment of a cord lock mechanism, a handle, and a drive mechanism for actuating a cord in a blind system.

Figure 18:
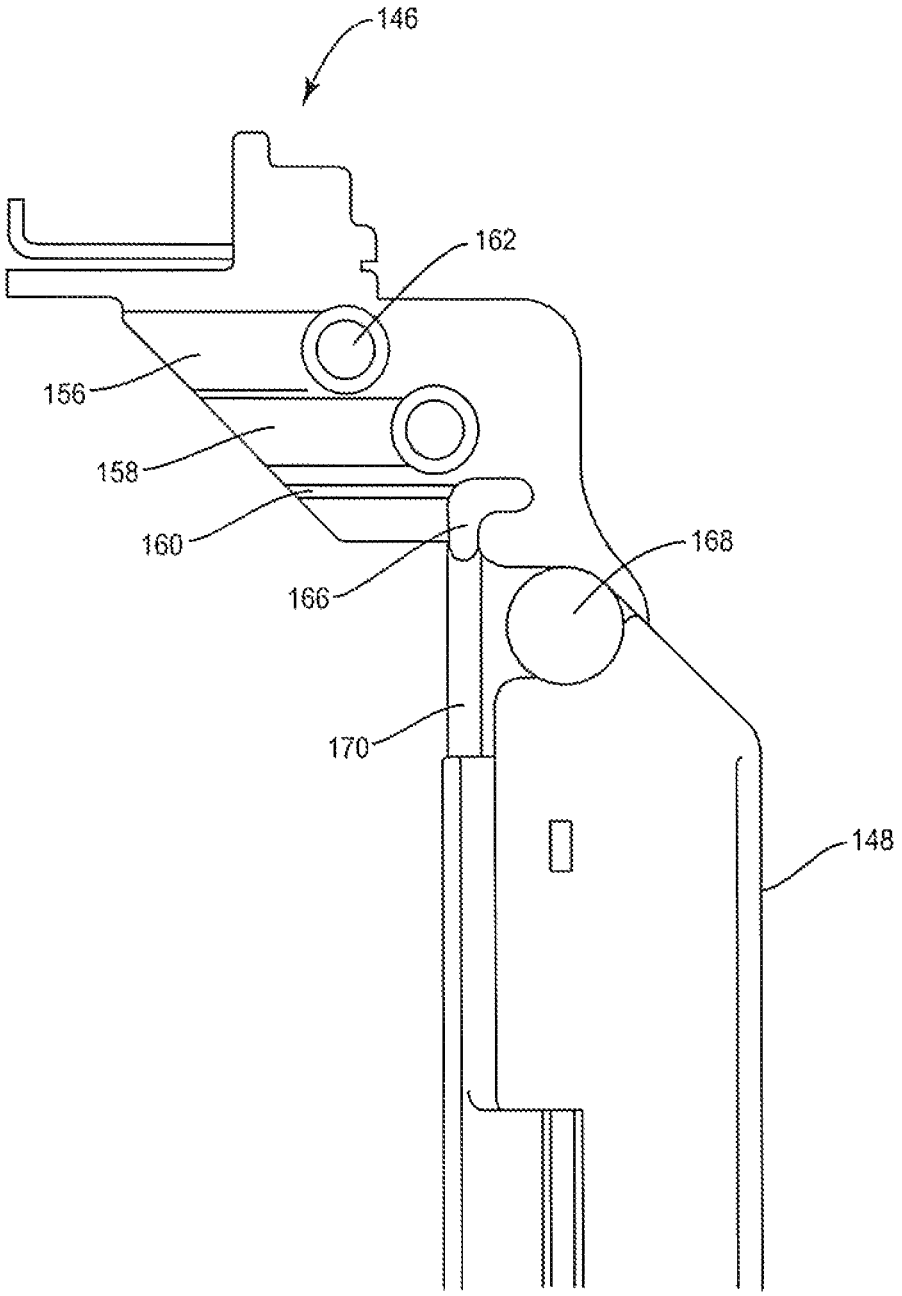

FIG. 18 shows a cross sectional view of the cord lock mechanism.

Figure 19:
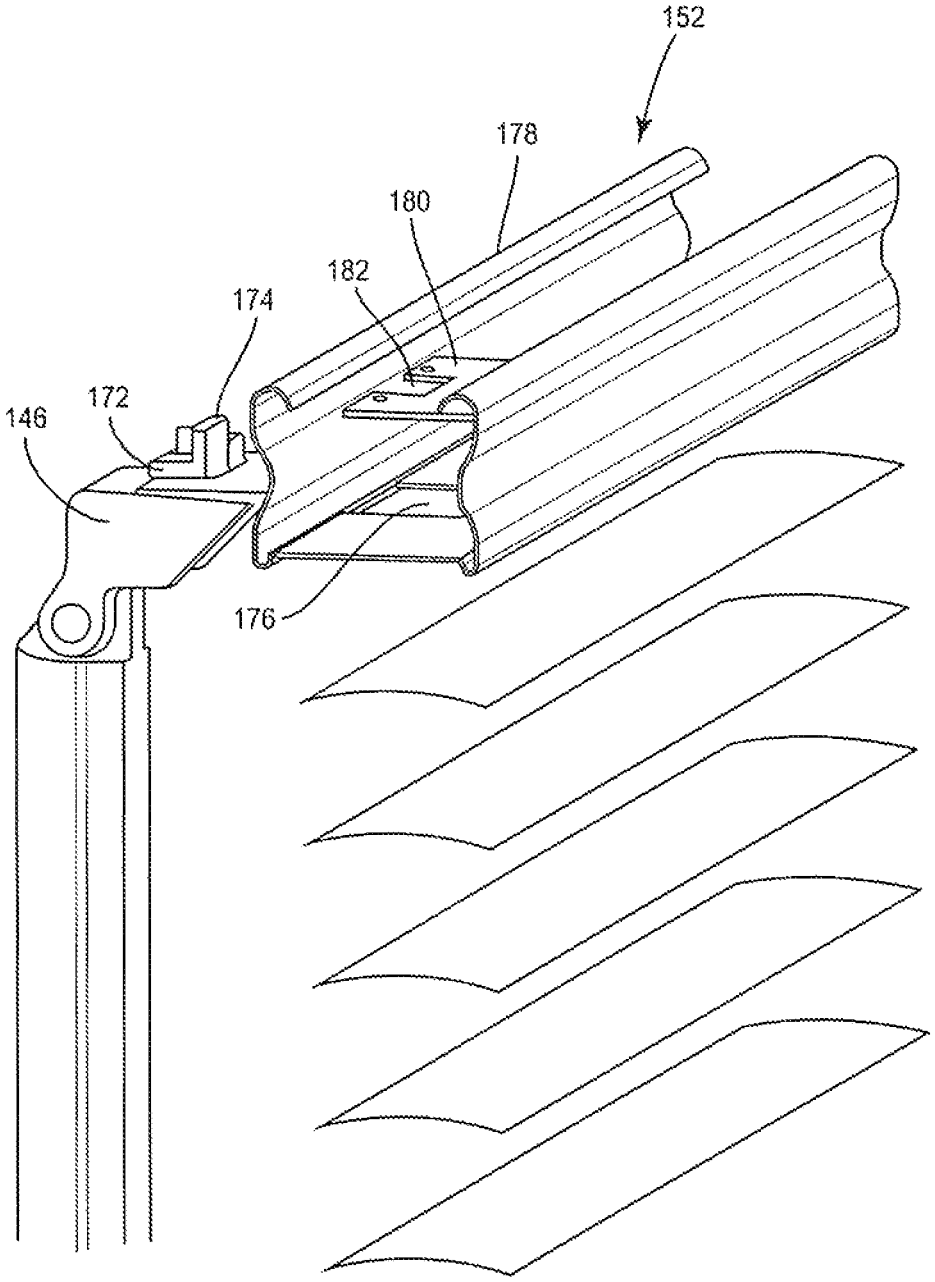

FIG. 19 shows a view of the handle separated from a headrail in the blind system.

Figure 20:
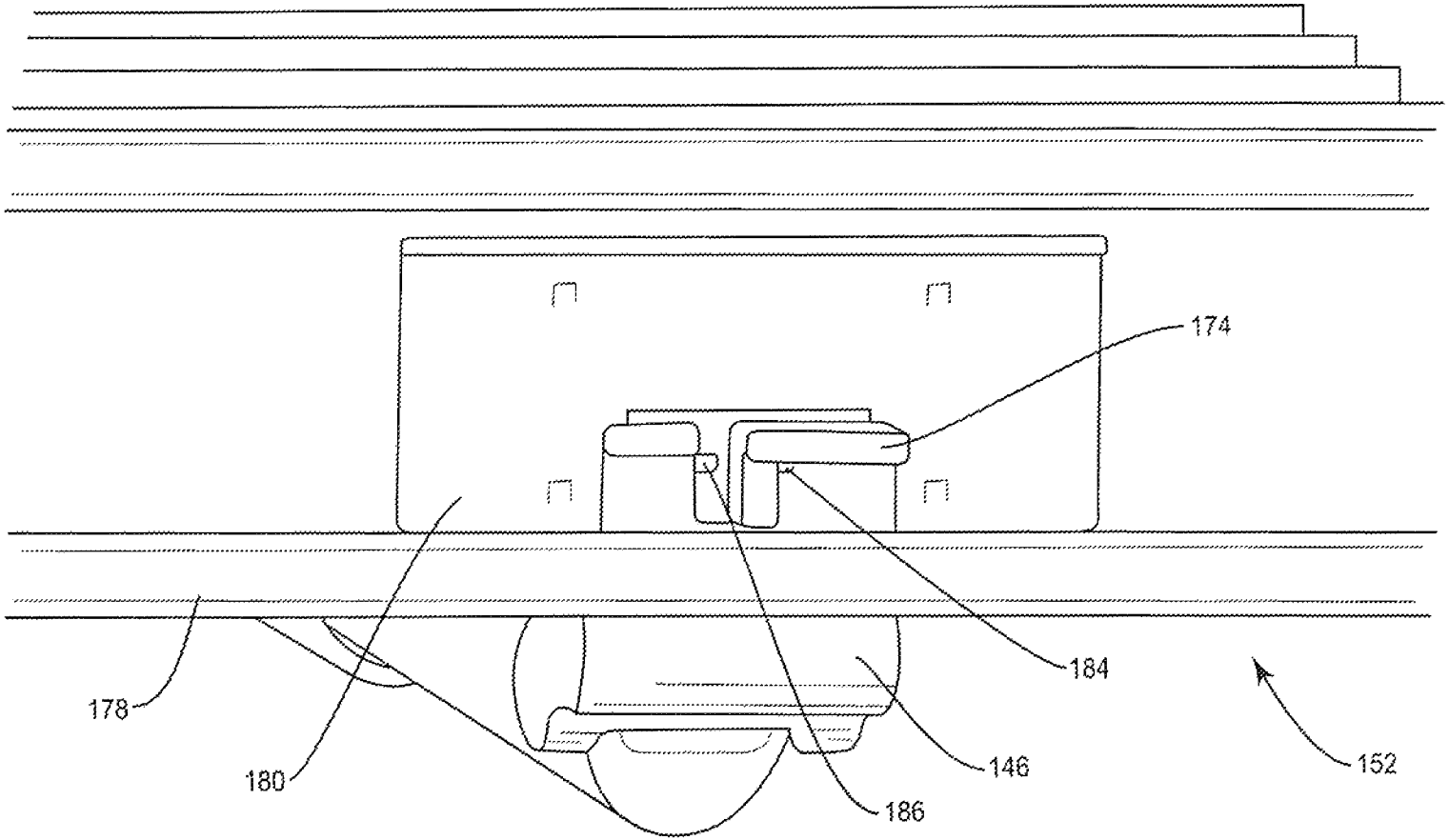

FIG. 20 shows a top view of the handle attached to the head rail.

Figure 21:
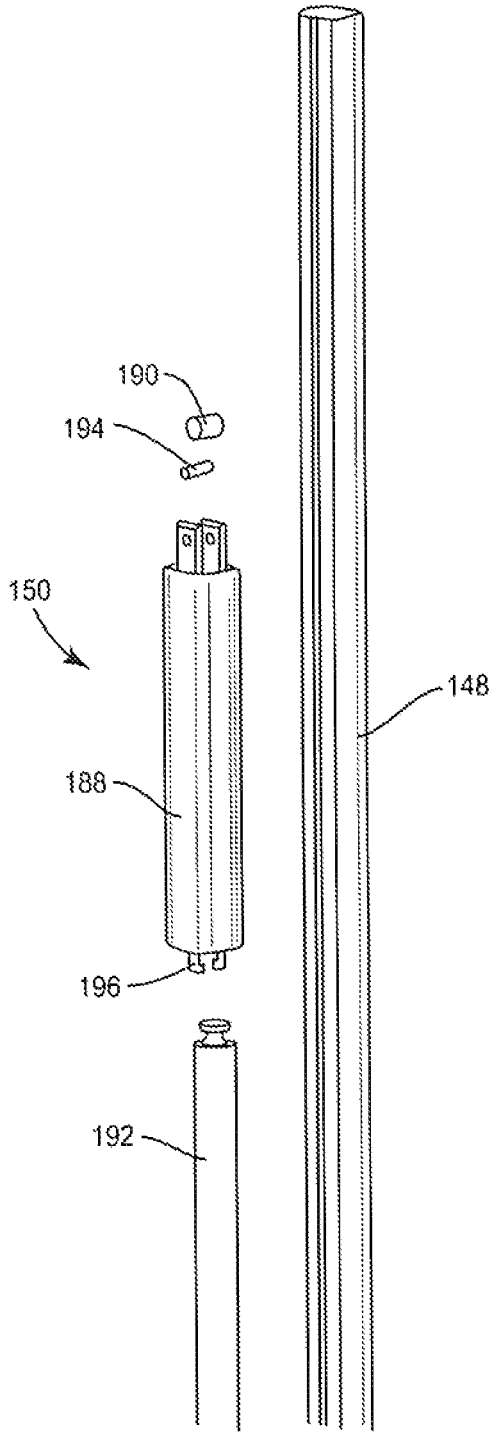

FIG. 21 shows an exploded view of the driving mechanism and the handle.

Figure 22:
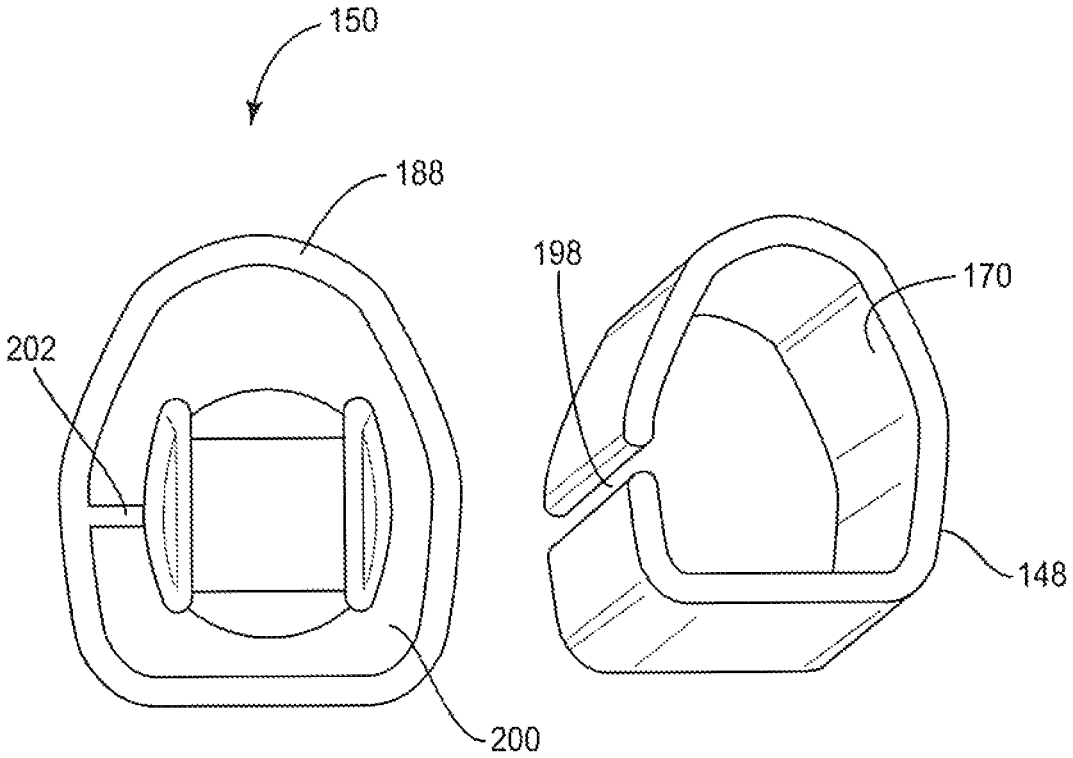

FIG. 22 is a top view of the driving mechanism and the handle.

Figure 23:
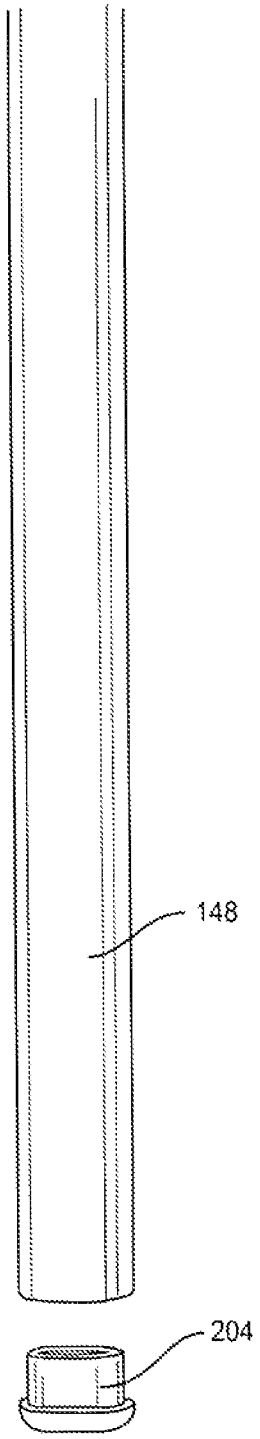

FIG. 23 is an exploded view of the bottom of the handle.

Figure 24:
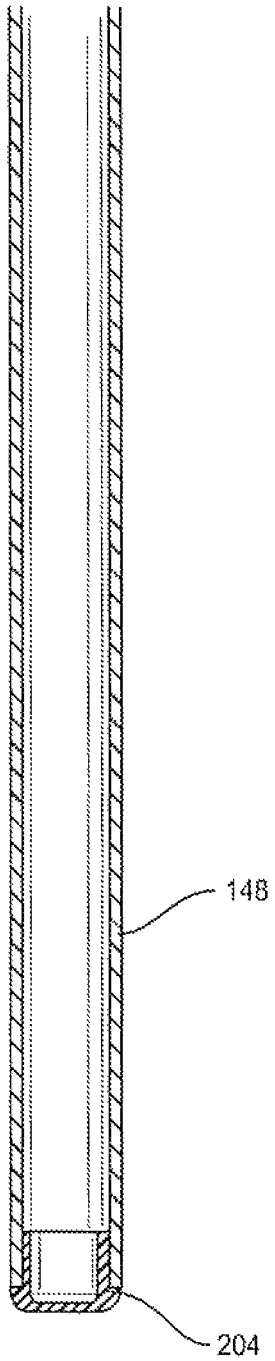

FIG. 24 is a cross-sectional transparent view of the bottom of the handle.

DETAILED DESCRIPTION

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

The present invention relates to cordless or encased corded drive systems for architectural covers for architectural openings, such as windows, doors or the like.

The term "enclosure" or "housing" as used herein refers to any elongated encasement (wand) of one or more lift cords that may be coupled with one or more drive mechanisms to deter or preclude access to the cords by a human, particularly a child. The enclosure or enclosed drive system may include one or more openings to allow for a handle exterior to the encasement to be coupled to or engaged with the drive mechanism internal to the encasement for driving the pull cords along the encasement.

The term "drive mechanism" as used herein refers to any apparatus capable of engaging one or more lift cords, and optimally adapted to fit within an enclosure or enclosed drive system. In one embodiment, the drive mechanism may allow direct secured attachment of the cord thereto in a 1:1 ratio of drive mechanism to bottom rail of the window covering with which the other end of the pull cords are attached. In a separate embodiment, the drive mechanism may act as a pulley or group of pulleys, wherein the pull cord is secured in the enclosure or enclosed drive system, or within the headrail, to allow a 2:1 or greater ratio of drive mechanism to bottom rail of the window covering. The dive mechanism in various embodiments may be secured to a handle that is exposed exterior to the enclosure or enclosed drive system to allow a user to operate the drive mechanism to raise and lower the window covering.

The term "cord lock disablement mechanism" as used herein refers to any device capable of keeping the cord lock mechanism from raising upon a retraction of the pull cord back into the headrail once the weight of the blinds pulls upon the cords, or may simply include a removal of the cord lock.

The term "drive system" as used herein refers to one or more embodiments of the present invention The term "architectural cover" includes any cover known to one of skill in the art for an architectural opening, including but not limited to Venetian blinds, roman shades and the like.

The advantages and features of the invention are further illustrated with reference to the following disclosure, which is not to be construed as in any way limiting the scope of the invention, but rather as being illustrative of embodiments of the invention in specific implementations thereof. Reference may be made herein to shades, blinds, and other types of architectural opening covers, but such references are not intended to be limitingly construed as regards the scope of the invention.

Window blinds all generally work in a same or similar fashion. The blind is manipulated by pulling a lift cord or by pulling the covering itself. In the case of a lift cord, strings that connect to the bottom of the window covering are pulled by the cord. The bottom of the window covering moves higher as the cord is pulled and moves lower as the cord is released. The window covering often either folds, rolls or collapses. In applications such as Venetian blinds, the blinds must first be aligned so that they can be lifted and nested in a compacted form.

Venetian blinds contain many individual blinds, called slats, which are generally maintained in an orientation parallel to each other. When the blind is fully lowered, the slats are generally the same distance apart and can all be turned at the same time in the same direction. When the slats are turned so that they are parallel to the window and all touching, most of the light from outside a window is blocked. Turning the slats perpendicular to the window allows light to pass through the open area between adjacent slats.

Turning the slats is accomplished by turning a rod that rotates the slats up or down. Typically three sets of three strings run through each slat; and each set of strings operates in the same way. The middle string raises and lowers the blinds, while the outer two strings form a ladder with a slat on each rung. Turning the rod tilts the slats. Lifting the blinds lets the most amount of light through the window, since all the slats are moved out of the way. The slats generally must first be turned perpendicular to the window, which allows them to collapse against each other when the bottom of the blinds is lifted. When the lift cord is pulled, the blinds rise.

To keep the blinds lifted at any given level, a cog often with teeth (cord lock) sits inside the rail into which the lift cord runs. When the lift cord is pulled towards the cog, usually towards the right when facing the blinds, the cog's teeth catch on the cord. When the lift cord is released, gravity causes the blinds to fall and the lift cord to retract. When the cog is caught on the lift cord, which then gets caught between the rail as well, the cog keeps the lift cord from retracting further and holds the blinds in place. Additionally, there must be some method for the lift cord to remain stationary once the window covering has been raised or lowered to the desired position. In some applications, the cord is wrapped around a hook fastened into the wall.

Traditional blinds have 1-inch slats formed of aluminum, plastic or wood. Shade and blind systems are often supported by a headrail that may include rolled edges at the top, light blocking lip at the lower back side and a curved headrail face similar to the crown of a 1" slat. Headrails are often open at the top similar to the conformation of a storm gutter. Headrails are often phosphate-treated steel and finished with a polyester primer and topcoat of polyester-baked enamel and measures 0.025" in thickness. The bottom rail that lifts the blinds from the bottom is generally tubular-shaped and is often phosphate-treated steel with polyester primer and a top coat of polyester-baked enamel and measures 0.025" in thickness. The slats that form the shaded portion of the blinds are frequently made of cold rolled aluminum alloy. The slats are nominally 1" wide and available in standard 0.006" or optional 0.008" thickness and nominally ½" wide by 0.006" thick.

Figure 1:
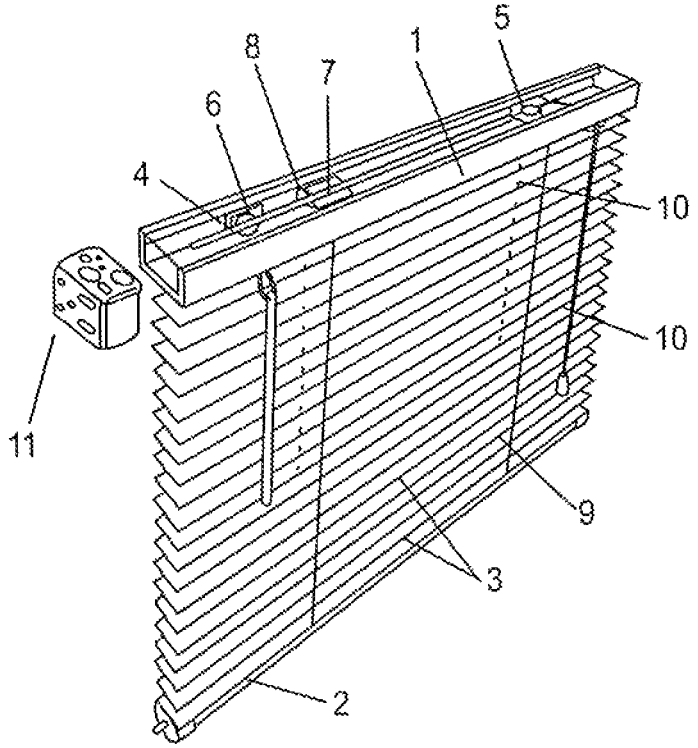
FIG. 1 PRIOR ART
FIG. 1 is a perspective view of an illustrative prior art common blind system.

FIG. 1 (PRIOR ART) of the present disclosure shows a prior art blind system that includes a headrail 1 that supports the blind system and a bottom rail 2 that is attached to the lift or pull cord 10 to draw up the blinds. Further shown is a cord lock 5 that is often a snap-in design with a stainless steel wear guard and a floating locking pin or cog 12. A tilter 4 is shown that allows for tilting of the blind, either in a perpendicular or horizontal orientation, to let in a desired amount of light or to block the light in an architectural opening, wherein the tilter 4 works with a tiltrod 6 that is supported by a tiltrod support 7. Tilting of the blinds may be effected by the exterior cords or ladders 9 that act on the periphery of the blind slats 3 by way of ladder drums 8 that are often low friction thermoplastic with smooth hole edges to position the ladders 9. The lift cord 10 runs internally (of the 3 cords) through the blinds and up through the headrail, out to where a user can pull open the blinds or release them to a closed condition. Lift cords 10 are often made of braided polyester, measuring 1.4 mm in diameter. The snap-in brackets 11 are used to mount the blind system.

Figure 2:
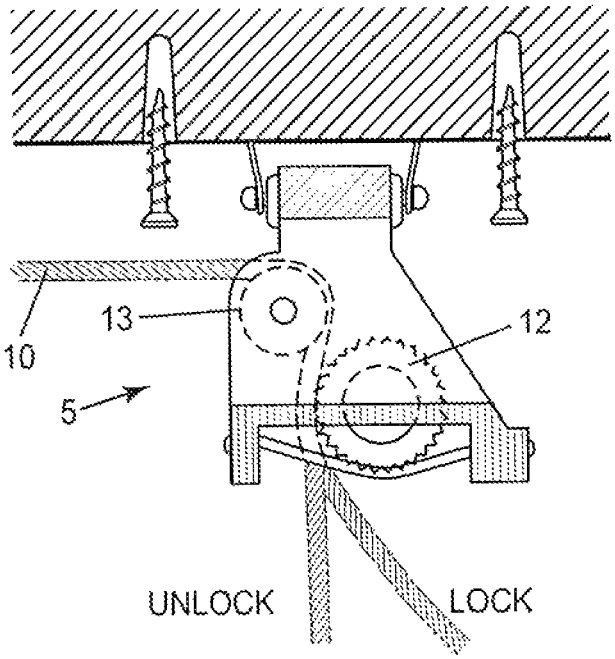
FIG. 2 PRIOR ART
FIG. 2 is a close-up view of a prior art cord lock system.

FIG. 2 (PRIOR ART) shows a close-up view of a cord lock 5 mechanism, with a locking cog 12 that must be disabled in various embodiments of the present invention, particularly to retro-fit existing blind systems. Further shown is a cord guide 13 including a rotating wheel or other mechanism, to allow smooth traversing of the cord 10.

Figure 3:
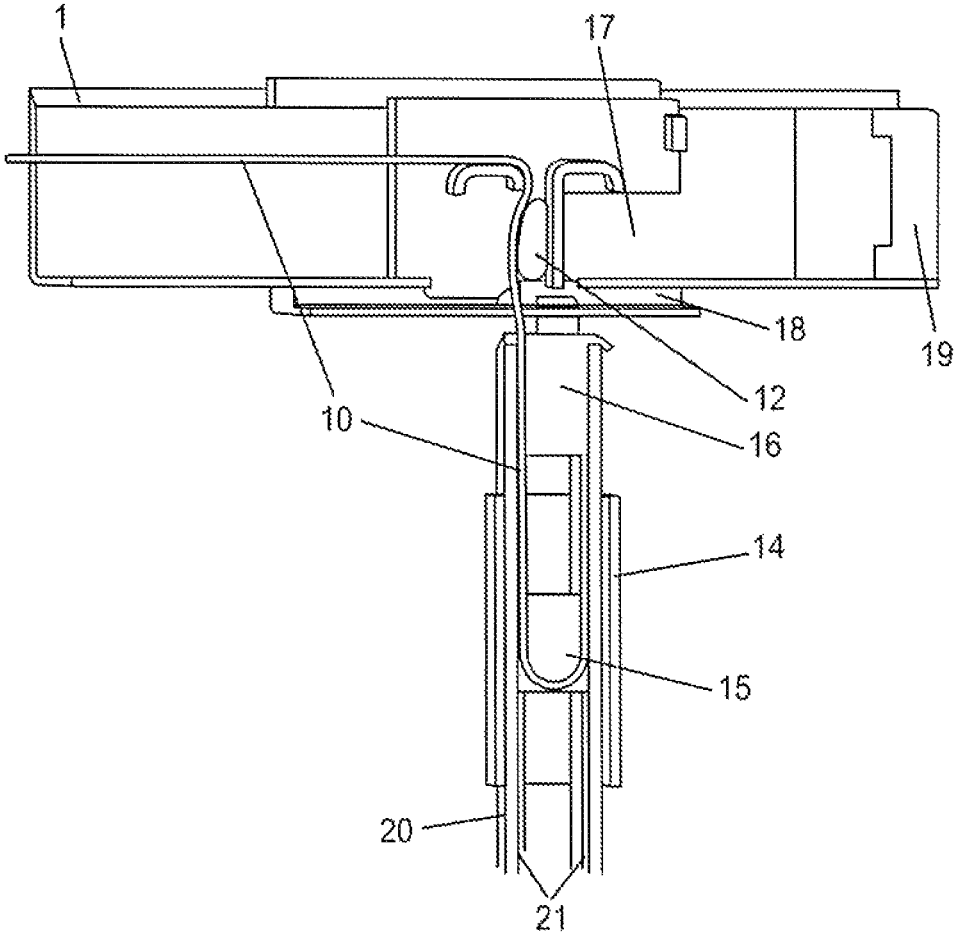
FIG. 3 is a representative view of the internal workings of an enclosed drive system for use in conjunction with a lift cord extending from a headrail of an architectural cover.

FIG. 3 is a representative view of the internal workings of an enclosed drive system for use in conjunction with a lift cord 10 extending from a headrail 1 of an architectural cover. The cog 12 of the cord lock 5 is often first disabled in existing blind systems to allow a free flowing cord 10 to raise and lower the architectural cover, wherein the disablement can be made by any suitable apparatus, such as a shank, hook, clip or other cord lock disablement mechanism 17 that is operative to keep the cog from raising when the weight of the blind/shade draws the cord 10 back into the headrail 1. It should be apparent that the cog 12 and cord lock disablement mechanism 17 would be absent in new blind systems incorporating an enclosed drive system of the present invention. The cord lock disablement mechanism 17 can be inserted through the end 19 of the headrail 1 or through an opening 23 (FIG. 5) where the cord 10 exits the headrail 1.

A bracket 18 may be secured to the headrail 1 to support the enclosure 20 and drive system. The bracket may be attached via a top cap 16, coupler 29, or similar means for securing the enclosure 20 to the headrail. The bracket 18 can either be slid on from one end 19 of the headrail 1 adjacent the cord lock mechanism 5 or alternatively clipped on with the use of a bracket 18 that either has one or more hinges 24 (FIG. 6) and/or is flexible enough to allow manual snapping of the bracket 18 from its open end over the headrail 1 from the bottom or side where lip extensions 25 would secure the bracket 18 in place once it is secured over the headrail 1. In the illustrative embodiment shown, the top cap 16 secures the cord(s) 10 at an end opposite the end(s) attached to the bottom rail 2 to draw up the blinds/shades, wherein the cord(s) 10 is engaged with a drive mechanism 15 coupled to the handle 14, wherein the drive mechanism 15 can be comprised of a pulley wheel or semi-circular member sufficient to draw the cord 10. As an alternative, the cord 10 can be locked, fastened or secured directly to the mechanism 15 coupled to the handle 14 so that a 1:1 ratio of handle pull to blind or shade draw is effectuated.

The handle 14 is attached to the drive mechanism 15 to allow a user to manually operate the opening and closing of the blinds/shades. The handle 14 may include an assembly or mechanism for locking it in place, e.g., locking bars, cams, pegs, etc., together with tension mechanisms for tightening the handle 14 around the enclosure 20 at any specific location along its length. There may be more than one pulley to allow for greater force and less distance being required in the handle 14 to draw up the shades/blinds, where a single pulley allows for a 2:1 ratio of handle to blind distance and force; a two pulley system allows for a 4:1 ratio of handle to blind distance and force; and so on. The drive mechanism 15 may optionally run on inner rails 21 of the enclosure 20.

Figure 4:
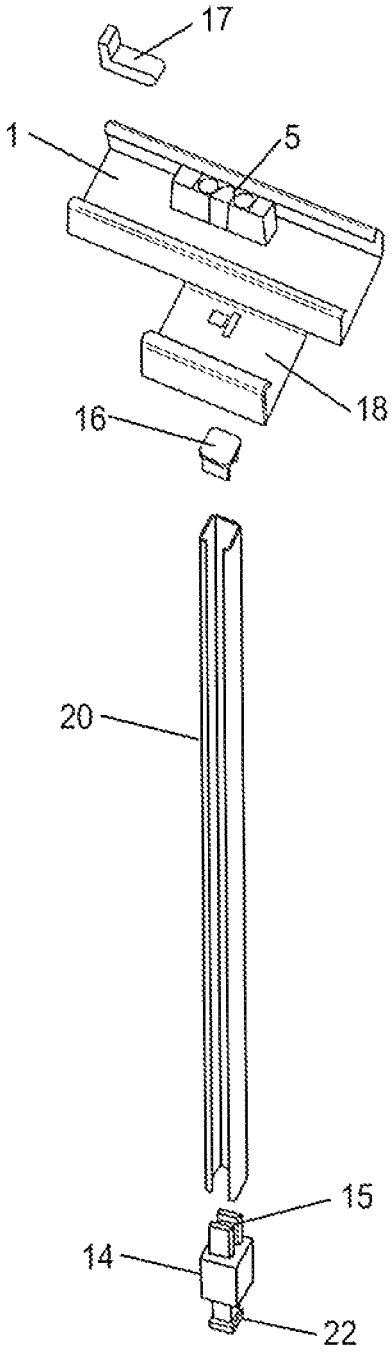
FIG. 4 is a representative top-down exploded view of an enclosed drive system for use in conjunction with a lift cord extending from a headrail of an architectural cover.

FIG. 4 is a representative top-down exploded view of an enclosed drive system for use in conjunction with a lift cord 10 extending from a headrail 1 of an architectural cover. The same representative elements of FIG. 3 are shown here. The cord lock disabling mechanism 17 slides in from the side in this embodiment.

Figure 5:
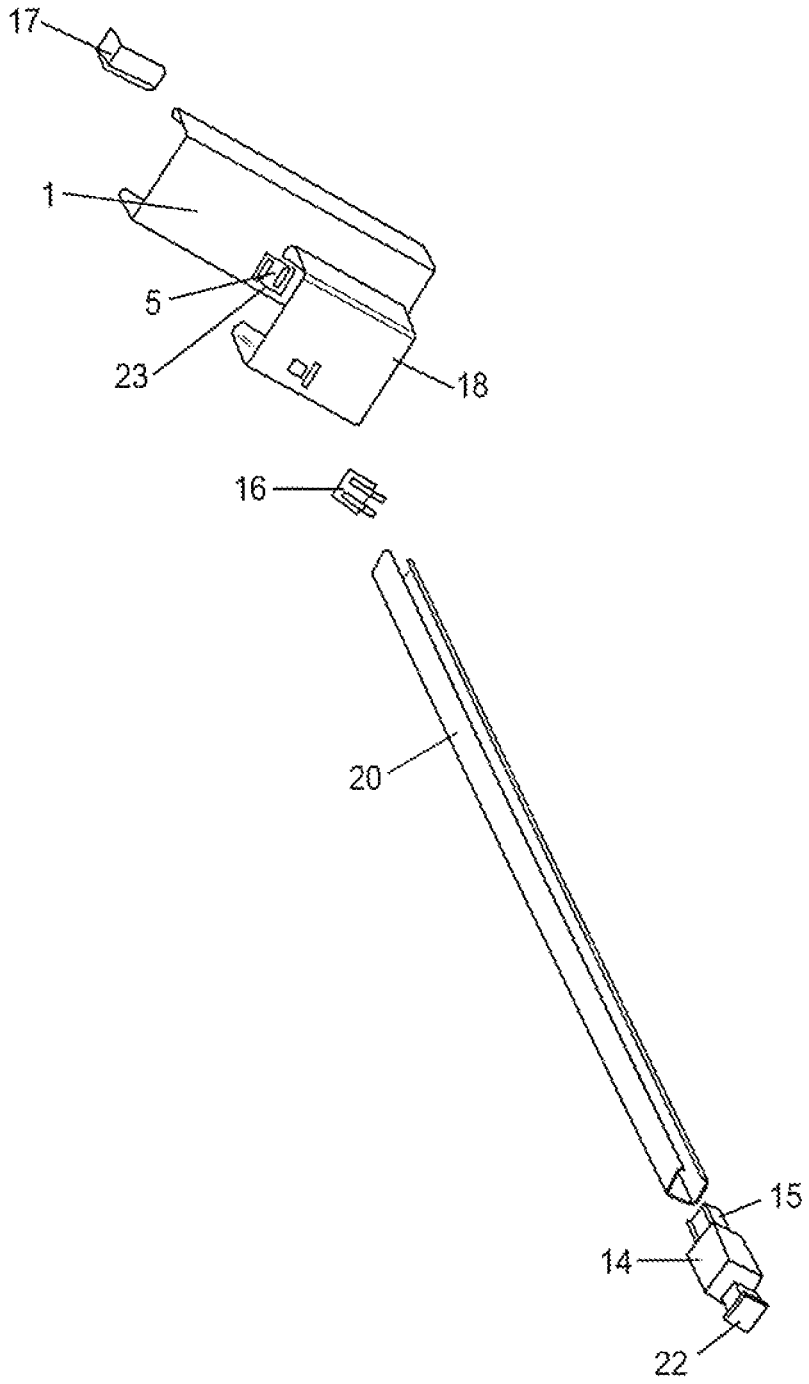
FIG. 5 is a representative bottom-up exploded view of an enclosed drive system for use in conjunction with a lift cord extending from a headrail of an architectural cover.

FIG. 5 is a representative bottom-up exploded view of an enclosed drive system for use in conjunction with a lift cord 10 extending from a headrail 1 of an architectural cover. The same representative elements of FIG. 3 are shown here. The cord lock disabling mechanism 17 can enter in from the opening 23 in the headrail f in this embodiment. Also shown is the bottom cap 22 of the enclosure 21).

Figure 6:
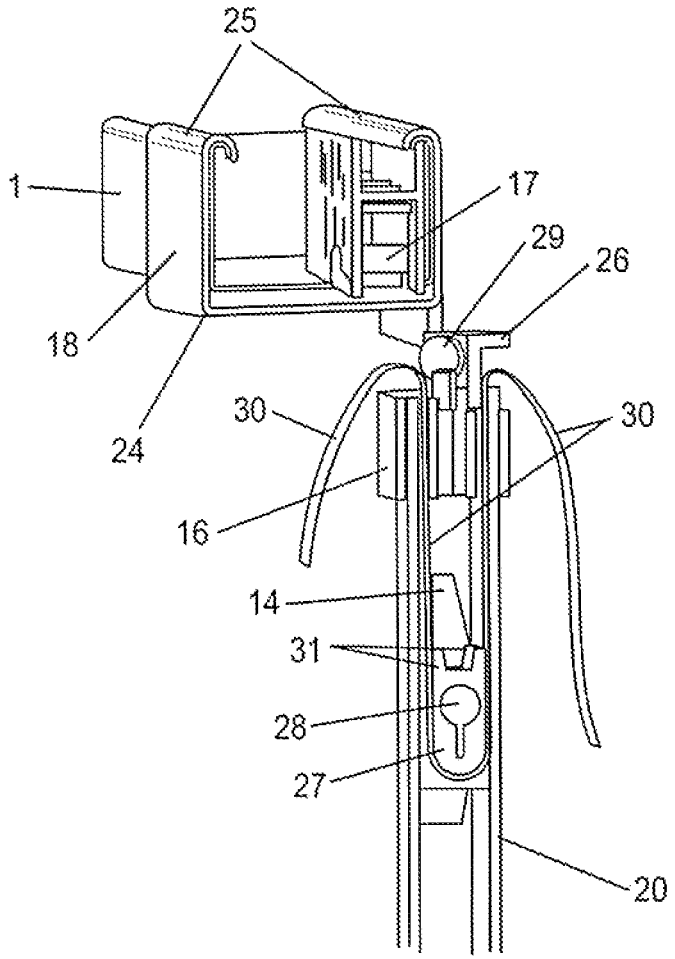
FIG. 6 is a representative view of an enclosed drive system for use in conjunction with a lift cord extending from a headrail of an architectural cover.

FIG. 6 is a representative view of an enclosed drive system for use in conjunction with a lift cord 10 extending from a headrail 1 of an architectural cover. In this embodiment, a pull strip 30 is shown for engaging the end of the lift cord 10 during retro-fit of an existing blind system. During a retro-fit, an existing blind system's lift cord 10 would be cut near the headrail 1, but with sufficient slack or length to allow the cord to be drawn into the enclosure 20 and likely back out near the top proximate to the top cap, where it may be secured with a cord lock mechanism 26. The cord is then either pulled down and attached to the drive mechanism 27 for a 1:1 pull cord power system, or pulled down around a pulley based drive mechanism 27 and out the other side of the top of the enclosure 20 where it is secured in place for a greater than 1:1 system. For individuals who are shorter or for any other reason have difficulty reaching the handle 14 at a certain height, a greater amount of slack lift cord 10 can be drawn into the enclosure 20 to allow the drive mechanism 15 and handle 14 to begin drawing up the blind or shade at a much lower point along the shaft of the enclosure 20, wherein the enclosure 20 can be extended to any necessary length.

The pull strip 30 includes some means for engaging the cord 10, whether it is an adhesive, separate cord, or similar apparatus so that it can be pulled into the enclosure 20, around the drive mechanism 27 and out the other side and then detached once the cord 10 is secured to the enclosure. In the 1:1 drive system, the lift or pull cord 10 attached to the pull strip 30 is pulled out at a point adjacent or through the handle 14 and secured therein, either with a cap, clamp, or similar device such as a cord lock mechanism 26 that locks into a top cap 16 after the cord is pulled through. The top cap 16 is attached to the bracket 18 by any one of a number of means or coupler 29, including via a D-ring as shown 29 in FIG. 6, a hinge, a ball and socket joint, a rivet, a toggle, a hook and eye, a clasp, a tie, or the like. A hinge (FIG. 7) would necessarily allow a bi directional movement of the shaft of the enclosure 20 towards and away from the blinds or shade, and a D-ring 29 would allow multi-directional movement.

Additionally disclosed is a close pin shaped drive mechanism 27 that has a channel for the lift cord 10 to be pulled through by the pull strip 30, and two semi-flexible extended caliper members 31 that partially encircle an oblong shaped cam type shaft 28 that is attached to the handle 14 so that when the handle 14 is rotated, the cam shaft 28 expands the caliper members 31 lock the drive mechanism 27 in place within the enclosure 20. Such an enclosure 20 could additionally include the inner rails 21 as in the other enclosed embodiments, but are not necessary so long as interior of the enclosure can sufficiently permit the drive mechanism 27 to traverse the length of the enclosure and yet accommodate the pressure of the caliper members 31 as a result of the cam shaft 28 when in a locked position.

FIG. 7 discloses an exploded view of an enclosed drive system attached to the headrail 1 of an architectural cover via a hinged bracket system. The unique cord lock disablement mechanism 17 in this embodiment is a hook that may be inserted through the opening 23 in the bracket where the lift cord 10 is exposed. The top cap 16 is attached to the bracket 18 via a second pin 34 that allows for bi-directional hinge movement. The bracket 18 is secured to the headrail 1 via the hinged wall portion 32 that is attached to the bracket via a first hinge pin 33. A cord fastening mechanism 26 is provided after the lift cord 10 is run through the enclosure 20 and around or engaged with the drive mechanism 27 that may be locked in place with the cam shaft 28 of the handle 14. The drive mechanism 27 may run the length of the internal rod enclosure 20 from the top cap 16 to the bottom cap 22.

A further example of the embodiment in FIG. 7 along with the pull strip 30 as in FIG. 6 is shown in FIG. 8. The embodiment of FIG. 8 exemplifies one retro-fit system of the present invention as represented prior to installation.

In FIG. 9, a particular embodiment of a drive mechanism 15 represented by the slide rail incorporating a pulley mechanism 27 which may also be described as a cam lock slider. The cam lock slider 27 includes two semi-flexible extended caliper members 31 for expansion when the cam 28 spreads them apart, forcing the calipers 31 to create pressure and friction within the enclosure 20 to stop the cam lock slider. Also enclosed is a spring steel string guide 35 that reduces friction as the lift cord passes around the cam lock slider 27.

FIG. 10 is a representative view of the handle 14 and the cam 28 in various positions, including locked where the calipers 31 are expanded, and unlocked where the calipers return to their normal position so that the cam lock slider 27 can freely move up and down the enclosure 20.

FIG. 11 is a representative view of a pull strip 30, preferably made of mylar tape, for drawing the lift cord through the enclosed drive system.

FIG. 12 is a representative view of the drive mechanism 27 being engaged with the enclosure 20, wherein a fastener 36 is utilized to secure the two in place.

FIGS. 13A-D are representative views of the installation of a cord lock disablement device 17 installation. Also shown opposite the hook is an L shaped extension that engages the bracket 18 to keep it from sliding along the headrail 1 when installed.

FIG. 14 is a representative view of the hinged embodiment of an enclosed drive system being installed on a headrail 1.

FIGS. 15 and 16 disclose various other embodiments, particularly including a cord lock mechanism 137 located near the headrail to pinch the cord 10 when in a relatively vertical position 143 and unlock the cord 10 when in a predetermined angle 144 from the relatively vertical position.

FIG. 17 illustrates yet another embodiment of a cord lock mechanism 146, a handle 148, and drive mechanism 150 for actuating a cord (shown in FIG. 15) in a blind system 152. FIG. 18 shows a cross sectional view of the cord lock mechanism 146. In this embodiment, a housing 154 of the cord lock mechanism 146 may define three vertically stacked channels 156, 158, 160. The top channel 156 and the middle channel 158 each include cord guides 162, 164. A cord locking member 166 is movably received within the bottom channel 160. The cord locking member 166 may be a part of the handle 148. When the handle 148 is relatively vertical, the cord locking member 166 is in a cord locking position which pinches the cord and prevents the cord from being actuated.

Next, a hinge 168 may couple the handle 148 to the housing 154 which allows the handle 148 to be moved about the hinge 168. Moving the handle 148 about the hinge 168 causes the cord locking member 166 to move within the bottom channel 160 or rotate outside of the bottom channel 160 into a cord release position that allows the cord to be moved. In this embodiment, the cord locking member 166 is moved to a cord release position when the handle 148 is moved about the handle 148 to an angle of approximately 15° or greater. This angle however may vary in other embodiments depending on factors such as the particular dimensions of the cord locking mechanism 146 or regulatory and standardization requirements. As in previous embodiments, the cord is guided within an enclosure 170 defined within the handle 148.

FIGS. 19 and 20 illustrate one method of attaching the cord lock mechanism 146 to the blind system 152. To do this, a channel 172 is provided at the bottom of a cord control apparatus 174 in the cord lock mechanism 146. The cord control apparatus 174 may be inserted through an aperture 176 defined in a headrail 178 of the blind system 152. A bracket 180 defines an opening 182 which allows the bracket 180 to be slid into the channel 172 on the cord control apparatus 174 and thereby secure the cord lock mechanism 146 in the headrail 178. Aperatures 184, 186 in the cord control apparatus 174 allow the cord to pass through the cord locking mechanism 146.

FIG. 21 illustrates the handle 148 and the drive mechanism 150 for actuating the cord. The drive mechanism 150 may include a slider 188, a cord guide 190, and a counterweight 192. A cord guide shaft 194 may be utilized to attach the cord guide 190 to the slider 188. A bracket 196 on the bottom of the slider 188 may be utilized to attach the counterweight 192 to the bottom of the slider 188.

FIG. 22 illustrates a top view of the handle 148 and the drive mechanism 150. The handle 148 defines the enclosure 170 and a slit 198. The slider 188 has an enclosure 200 and a sliding member 202 that may be attached to the enclosure 200. The enclosure 200 may receive the handle 148 so that a portion of the handle 148 is enclosed by the slider 188 and the sliding member 202 is received within the slit 198. In this manner, the slider 188 can slide along the length of the handle 148 while the cord guide 190 and the counterweight 192 are each enclosed within the enclosure 170 provided in the handle 148. The cord may loop around the cord guide 190 so that the cord may be actuated to raise and lower the blind system 152 (shown in FIG. 17) as the slider 188 is slid up and down the handle 148. In this embodiment, the counterweight 192 may provide a gravitational counter force that counters the weight of the blind system 152 when the cord locking member 166 (shown in FIG. 17) is placed in the cord release position. Other mechanisms, such as damping structures designed to provide the appropriate amount of friction, may also be utilized to counter the weight of the blind system 152.

Finally, FIG. 23 illustrates a bottom cap 204 for the handle 148. FIG. 24 illustrates a cross sectional transparent view of the bottom cap 204 inserted into a bottom end of the handle 148.

The invention has been has been described herein in reference to specific aspects, features and illustrative embodiments of the invention, some of which are numerically disclosed below:

1. headrail of a blind system
2. bottom rail of a blind system
3. blind slats
4. tilter device for opening and closing the blind slats 3
5. cord lock mechanism
6. tiltrod
7. tiltrod support
8. ladder drums
9. ladders
10. lift cord(s)
11. snap-in brackets used to mount the blind system
12. cog of the cord lock 5
13. cord guide
14. handle
15. drive mechanism
16. top cap
17. cord lock disablement mechanism
18. bracket secured to the headrail 1 to support the enclosure 20
19. one end of the headrail 1 adjacent the cord lock mechanism 5
20. enclosure
21. inner rails of enclosure 20
22. bottom cap
23. opening in the headrail 1 for inserting cord lock disabling mechanism 17
24. one or more hinges on bracket 18
25. lip extensions of bracket 18
26. cord fastening mechanism separate from top cap 16
27. slide rail incorporating a pulley mechanism with locking apparatus engaged with an oblong shaped cam 28 of a handle 14
28. oblong shaped cam that expands calipers 29 of slide rail 27
29. coupler that attaches the enclosure 20 to the bracket 18 via the top cap 16
30. pull strip for cord 10
31. semi-flexible extended caliper members
32. hinge wall portion of bracket 18
33. first pin for hinge wall 32 of bracket 18
34. second pin to hinge to allow bi-directional movement of enclosure
35. spring steel string guide
36. fastener to secure top cap 16 and the enclosure 20 together
115. drive mechanism of alternate embodiment
116. top cap of enclosure or housing 120, that may be adapted to secure cord(s)
120. enclosure or housing for drive system to conceal cord(s) 10
126. point where top cap 116 secures the cord(s) 10
128. axle of pulley mechanism 141 coupled to drive mechanism or slider bar 115
137. lock mechanism activated by a hinge 138 when the enclosure or housing 120 is in a relatively vertical position 143, and unlocked when at a predetermined angle 144 from the relatively vertical position
138. hinge mechanism attaching the enclosure or housing 120 to the headrail 1
139. axle of hinge mechanism 138
140. brushing of hinge mechanism 138
141. roller of pulley mechanism coupled to drive mechanism or slider bar 115
142. cord control apparatus to ensure smooth travel of cord into enclosure or housing 120 of drive system
143. relatively vertical position wherein the enclosure or housing 120 hangs when no external force is exerted thereon other than gravity; or relatively parallel to the Y axis as shown in FIG. 15
144. predetermined angle compared with that of the relatively vertical position 143, wherein the lock mechanism 137 may be disabled in certain embodiments
146. cord lock mechanism having housing 154
148. handle
150. drive mechanism having a slider 188, a cord guide 190, a counterweight 192, and a cord guide shaft 194
152. blind system having a headrail 178
156. hinge that movably couples the handle 148 to the housing 154 of the cord lock mechanism 146

180. bracket for attaching the cord lock mechanism 146 to the headrail 178.

204. bottom cap inserted into a bottom end of the handle 148

While the invention has been has been described herein in reference to specific aspects, features and illustrative embodiments of the invention, it will be appreciated that the utility of the invention is not thus limited, but rather extends to and encompasses numerous other variations, modifications and alternative embodiments, as will suggest themselves to those of ordinary skill in the field of the present invention, based on the disclosure herein. Any of various elements or features recited herein is contemplated for use with other features or elements disclosed herein, unless specified to the contrary. Correspondingly, the invention as hereinafter claimed is intended to be broadly construed and interpreted, as including all such variations, modifications and alternative embodiments, within its spirit and scope.

Those skilled in the art will recognize improvements and modifications to the preferred embodiments of the present disclosure. All such improvements and modifications are considered within the scope of the concepts disclosed herein and the claims that follow.

What is claimed is:

1. A drive system for use in conjunction with one or more lift cords extending from a headrail of an architectural cover, said drive system comprising:

a headrail;

an enclosure configured to conceal at least a portion of at least one lift cord;

a first drive mechanism in the enclosure, configured to engage the at least one lift cord, and coupled to a handle mechanism for manual operation;

a locking mechanism hingedly attached to the enclosure and located outside the headrail;

a bracket having a first end and a second end, the bracket configured to connect the enclosure to the headrail, wherein the first end of the bracket is secured to the headrail;

wherein the second end of the bracket is attached to the locking mechanism to secure the locking mechanism to the headrail; and wherein the locking mechanism is configured to secure the at least one lift cord in place.

2. The drive system of claim 1, wherein the handle mechanism comprises a sleeve adapted to slide along or within the enclosure.

3. The drive system of claim 1, wherein the handle comprises a counter-weight mechanism adapted to lessen the force required to move the handle.

4. The drive system of claim 1, wherein the bracket comprises a hinged wall portion and the bracket is secured to the headrail via the hinged wall portion.

5. A drive system for use in conjunction with one or more lift cords extending from a headrail of an architectural cover, said drive system comprising:

a headrail;

an enclosure adapted to conceal at least a portion of at least one lift cord and arranged to be secured to the headrail;

a first drive mechanism in the enclosure, adapted to engage the at least one lift cord, and coupled to a handle mechanism for manual operation;

a handle coupled to the first drive system; and a locking mechanism located outside the headrail, wherein the locking mechanism is hingedly attached to the enclosure and is secured to the headrail via a bracket, wherein a first end of the bracket is secured to the headrail, and wherein a second end of the bracket is attached to the locking mechanism to secure the locking mechanism to the headrail; and wherein the locking mechanism is configured to secure the at least one lift cord in place.

6. The drive system of claim 5, further comprising a counterweight mechanism coupled to the first drive mechanism and adapted to secure the handle in position at one or more locations along the enclosure.

7. The drive system of claim 5, wherein the bracket comprises a hinged wall portion and the bracket is secured to the headrail via the hinged wall portion.

8. A drive system for use in conjunction with one or more lift cords extending from a headrail of an architectural cover, said drive system comprising:

a headrail;

an enclosure configured to conceal at least a portion of at least one lift cord;

a first drive mechanism in the enclosure, configured to engage the at least one lift cord, and coupled to a handle mechanism for manual operation;

a locking mechanism hingedly attached to the enclosure and located outside the headrail; and a bracket having a first end and a second end, the bracket configured to connect the enclosure to the headrail of an architectural cover, wherein the first end of the bracket is secured to the headrail and the second end of the bracket receives the locking mechanism and secures the locking mechanism to the headrail, wherein the locking mechanism is configured to secure the at least one lift cord in place.

9. The drive system of claim 8, wherein the bracket comprises a hinged wall portion and the bracket is secured to the headrail via the hinged wall portion.

* * * * *